US007147396B2

(12) United States Patent
Tani

(10) Patent No.: US 7,147,396 B2
(45) Date of Patent: Dec. 12, 2006

(54) APPLYING FILLER EXTRUDING CONTAINER

(75) Inventor: Yoshikazu Tani, Tokyo (JP)

(73) Assignee: Tokiwa Corporation, Gifu (JP)

( * ) Notice: Subject to any disclaimer, the term of this patent is extended or adjusted under 35 U.S.C. 154(b) by 0 days.

(21) Appl. No.: 11/386,751

(22) Filed: Mar. 23, 2006

(65) Prior Publication Data

US 2006/0222450 A1 Oct. 5, 2006

(30) Foreign Application Priority Data

Mar. 31, 2005 (JP) ..... 2005-103350
Sep. 6, 2005 (JP) ..... 2005-258158

(51) Int. Cl.
*B05C 11/00* (2006.01)

(52) U.S. Cl. ..... 401/266; 401/277; 401/172; 401/179

(58) Field of Classification Search ..... 401/65, 401/68, 69, 75, 82, 171, 172, 174, 176, 179, 401/265, 266, 272, 277
See application file for complete search history.

(56) References Cited

U.S. PATENT DOCUMENTS 3,756,730 A * 9/1973 Spatz ..... 401/174
5,851,079 A * 12/1998 Horstman et al. ..... 401/174
5,879,095 A * 3/1999 Gueret ..... 401/172
6,918,515 B1 * 7/2005 Noguchi ..... 222/386

FOREIGN PATENT DOCUMENTS

JP 2004-089687 3/2004

* cited by examiner

*Primary Examiner*—Huyen Le
(74) *Attorney, Agent, or Firm*—Bacon & Thomas

(57) ABSTRACT

For improvement in sanitation, handling, usability and protection, an extruding container is structured such that, when the main body (1) and the leading tube (3) are relatively rotated in one direction, a filling member (4) having an applying portion (4*a*), a filling region (4*x*) containing an applying filler (L) and a discharge port (4*c*) moves forward by meshing operation of a first meshing portion (8), and when they are rotated further, the filler (L) is discharged from the discharge port (4*c*) of the filling member (4) by meshing operation of a second meshing portion (9) to be ready for use, and when the main body (1) and the leading tube (3) are relatively rotated in an opposite direction, the filling member (4) moves backward, by meshing operation of the first meshing portion (8) whereby the filling member (4) can appear from and retract into the leading tube (3).

14 Claims, 34 Drawing Sheets

APPLYING FILLER EXTRUDING CONTAINER

TECHNICAL FIELD

The present invention relates to an applying filler extruding container for extruding an applying filler so as to use.

BACKGROUND ART

In conventional, as an applying filler extruding container (a movable body feeding apparatus) for extruding an applying filler contained in the container, for example, a liquid filler so as to use, there has been known an applying filler extruding container which is provided with a main body tube having a filling region in which the applying filler is filled in an inner portion, an operating tube provided in a rear end portion of the main body tube so as to be relatively rotatable, a movable body accommodated within the main body tube and the operating tube and provided so as to be non-rotatable and movable in an axial direction with respect to the operating tube, and a meshing portion constituted by a thread in the main body tube side and a thread in the movable body side, wherein when the main body tube and the operating tube are relatively rotated, the movable body moves forward on the basis of meshing operation of the thread portions, and a piston provided in a leading end of the movable body moves forward, whereby the applying filler is extruded to the leading end side, and it is possible to apply the applying filler discharged through an opening in the leading end of the main body tube to an applied portion via an applying portion (an applying body) (refer, for example, to Japanese Unexamined Patent Publication No. 2004-89687, patent document 1).

DISCLOSURE OF THE INVENTION

Problem to be Solved by the Invention

In the container mentioned above, since the applying portion is naked, improvement in view of sanitation is required. In addition, improvement of a handling characteristic, a using characteristic and a using feeling, and protection of the applying filler are further required.

The present invention is made for achieving the problem mentioned above, and an object of the present invention is to provide an applying filler extruding container in which improvement in view or sanitation, improvement of a handling characteristic, a using characteristic and a using feeling, and protection of the applying filler can be achieved.

Means for Solving the Problem

In accordance with the present invention, there is provided an applying filler extruding container comprising:

a main body;

a leading tube installed in a leading end side of the main body so as to be relatively rotatable; and a filling member which moves forward into the leading tube, has an inner portion formed as a filling region in which the applying filler is filled, has a discharge port in a leading end portion and is provided with an applying portion for applying the applying filler discharged through the discharge port to an applied portion, wherein, when the main body and the leading tube are relatively rotated in one direction, meshing operation of a first meshing portion works and thereby the filling member moves forward, and when they are relatively rotated further in one direction, meshing operation of a second meshing portion instead of the first meshing portion works and thereby the applying filler is discharged from the discharge port of the filling member, and when the main body and the leading tube are relatively rotated in the other direction corresponding to an opposite direction to one direction, meshing operation of the first meshing portion works and thereby the filling member moves backward.

In accordance with the applying filler extruding container mentioned above, the structure is made such that the leading tube is installed in the leading end side of the main body so as to be relatively rotatable, and the filling member, which has the internal filling region with the applying filler being filled therein, the discharge port in the leading end portion and the applying portion for applying the applying filler discharged through the discharge port to the applied portion, moves forward into the leading tube, meshing operation of the first meshing portion works and thereby the filling member moves forward so as to be fed to the use position at a time when the main body and the leading tube are relatively rotated in one direction, meshing operation of the second meshing portion instead of the first meshing portion works and thereby the applying filler is discharged from the discharge port of the filling member so as to be set in the use state at a time when they are relatively rotated further in one direction, and meshing operation of the first meshing portion works and thereby the filling member moves backward at a time when the main body and the leading tube are relatively rotated in the opposite direction to one direction. As mentioned above, since the filling member in which the applying filler is filled moves forward, the structure can be made such that the filling member appears from the inner side of the leading tube at a time of being used, and is retracted into the leading tube after being used. Accordingly, it is possible to achieve improvement in view of sanitation, and protection of the applying filler by the leading tube, an entire length is shortened after being used so as to be made compact and the entire length is made proper at a time of being used, whereby a handling characteristic and a using characteristic (usability) are improved. In addition, it is possible to use in the same feeling as a container of a rod-shaped cosmetic material, for example, a lip stick or the like, and a using feeling can be improved.

In this case, as the structure of the applying filler extruding container in which the operation mentioned above can be preferably achieved, in particular, there can be shown a structure such that the applying filler extruding container is provided with a movable body moving forward and thereby extruding the applying filler in the filling region toward the discharge port, the first meshing portion works first meshing operation when the main body and the leading tube are relatively rotated in a feeding direction corresponding to one direction and a feed-back direction corresponding to the other direction, and thereby moves forward and backward the filling member including the movable body, the meshing operation is stopped when the filling member reaches a forward limit, and the second meshing portion works meshing operation when the main body and the leading tube are relatively rotated further in the feeding direction corresponding to the one diction in a state that the filling member reaches the forward limit and the meshing operation of the first meshing portion stops, and thereby moves forward the movable body.

In accordance with the applying filler extruding container mentioned above, the meshing operation works first by the first meshing portion, and the filling member including the movable body moves forward when the main body and the leading tube are relatively rotated in the feeding direction, the meshing operation of the first meshing portion stops when the filling member is fed to the use position corresponding to the forward limit, the meshing operation of the second meshing portion works, the movable body then moves forward and the applying filler within the filling member is extruded from the discharge port so as to be set in the use state when the main body and the leading tube are relatively rotated in the feeding direction, and the meshing operation of the first meshing portion works first and the filling member including the movable body moves backward when the main body and the leading tube are relatively rotated in the feed-back direction after being used.

In this case, as a preferable structure in which meshing operation of the first meshing portion works before the meshing operation of the second meshing portion, in particular, there can be shown a structure in which an actuation resistance of the second meshing portion is increased in comparison with an actuation resistance of the first meshing portion.

Further, as a preferable structure for increasing the actuation resistance of the second meshing portion, in particular, there can be shown a structure in which an elastic portion applying an elastic force to the second meshing portion is provided to utilize the elastic force of the elastic portion.

In this case, as a preferable structure of the elastic portion, in particular, there can be shown a ring-shaped elastic body installed to an outer peripheral side of a female thread constituting the second meshing portion.

Further, in the case of being provided with a click engagement portion which is click engaged in correspondence to the relative rotation between the main body and the leading tube at a time when the meshing operation by the second meshing portion works, a degree of the relative rotation and a moving degree of the movable body are detected by a user on the basis of a click feeling by the click engagement.

In this case, the click engagement portion may be constituted by a ratchet mechanism which regulates the relative rotation in the feed-back direction between the main body and the leading tube at a time when the meshing operation by the second meshing portion works, and allows only the relative rotation in the feeding direction.

Further, the first meshing portion is preferably structured such that, when the main body and the leading tube are relatively rotated in the feed-back direction and the filling member including the movable body moves backward on the basis of the first worked meshing operation of the first meshing portion so as to reach a predetermined position at which the applying portion is accommodated within the leading tube, the meshing is cancelled and the first meshing portion idly rotates the main body and the leading tube so that the meshing operation of the second meshing portion does not work, and the meshing returns when the main body and the leading tube are relatively rotated in the feeding direction in a state that the meshing is cancelled.

In the case of employing the structure mentioned above, when the main body and the leading tube are relatively rotated in the feed-back direction after the filling member reaches the forward limit and the applying filer is discharged from the discharge port on the basis of the forward movement of the movable body so as to be set in the use state, the filling member including the movable body moves backward on the basis of the first worked meshing operation of the first meshing portion, and reaches the predetermined position at which the applying portion is accommodated within the leading tube, the meshing of the first meshing portion is cancelled and the main body and the leading tube are idly rotated so that meshing operation of the second meshing portion does not work. Accordingly, the movable body does not move backward in this state, and the applying filler is in a state of having moved forward near the discharge port. Further, when the main body and the leading tube are relatively rotated in the feeding direction, the meshing of the first meshing portion returns, and the filling member including the movable body appears from the opening in the leading end of the leading tube. Accordingly, when the filling member reaches the forward limit and the movable body moves forward on the basis of the further relative rotation in the feeding direction between the main body and the leading tube, the applying filler in the state of having moved forward near the discharge port is immediately set to the use state. Therefore, the using characteristic (the usability) is improved.

Further, in the case that the applying filler extruding container is provided with a leading tube pressing member, which is accommodated within the main body and comprises a spring portion capable of expanding and contracting in an axial direction, and the leading tube is installed to the main body via the leading tube pressing member so as to be relatively rotatable in a state of being energized to a rear side by the spring portion of the leading tube pressing member, a rotational resistance having a good feeling is applied at a time when the main body and the leading tube relatively rotate, it is possible to buffer external force such as impact, vibration or the like, for example, applied due to drop of the container or the like, thereby to prevent the applying filler from leaking out from the discharge port and to prevent the member from being broken.

Further, in the case that the first meshing portion is structured such that the meshing operation is stopped when the main body and the leading tube are relatively rotated in the feed-back direction, the filling member including the movable body moves backward on the basis of the first worked meshing operation of the first meshing portion and the applying portion reaches the backward limit to be accommodated within the leading tube, and the second meshing portion is structured such that the meshing operation works so as to move backward the movable body when the filling member reaches the backward limit and the main body and the leading tube are relatively rotated further in the feed-back direction in a state that the meshing operation of the first meshing portion is stopped, the applying filler is sucked to the filling region from the discharge port of the filling member on the basis of the backward movement of the movable body, and a predetermined space is formed in an inner side from the discharge port of the filling member. Accordingly, since the applying filler remaining in the applying portion is reduced, an economical effect can be obtained. Further, even if the applying filler filled in the filling region and air mixing into the applying filler are expanded due to a change of temperature and a change of atmospheric pressure, it is possible to prevent the applying filler from leaking out from the discharge port on the basis of the predetermined space provided in the inner side from the discharge port.

Further, in the case that a lead of the first meshing portion is made larger (rougher) in comparison with a lead of the second meshing portion, it is possible to work the meshing operation of the first meshing portion before the meshing operation of the second meshing portion, the filling member to which the meshing operation of the first meshing portion works is quickly fed out to the use position in accordance with the large lead, on the basis of the relative rotation in the feeding direction between the main body and the leading tube, the movable body to which the meshing operation of the second meshing portion works is slowly fed out in accordance with the small (fine) lead on the basis of the further relative rotation in the feeding direction between the main body and the leading tube and the applying filler is suitably discharged from the discharge port of the filling member so as to be set in the use state, and the filling member is quickly fed back in accordance with the large lead on the basis of the relative rotation in the feed-back direction between the main body and the leading tube, after being used. As a result, the using characteristic (the usability) can be further improved. In this case, the lead means a distance moving in the axial direction at a time of rotating the thread at one turn.

Effect of the Invention

As mentioned above, in accordance with the applying filler extruding container of the present invention, since the filling member in which the applying filler is filled moves forward and backward, the structure can be made such that the filling member appears from the inner side of the leading tube at a time of being used, and is retracted so as to be accommodated into the leading tube after being used. As a result, it is possible to achieve improvement of the sanitation and protection of the applying filler by the leading tube, an entire length can be made short so as to be made compact after being used, and a suitable length can be set at a time of being used so as to improve a handling characteristic and a using characteristic (usability). In addition, it is possible to use the container in the same feeling as a container of a rod-shaped cosmetic material, for example, a lip stick or the like, and it is possible to improve a using feeling.

BEST MODE FOR CARRYING OUT THE INVENTION

Figure 1:
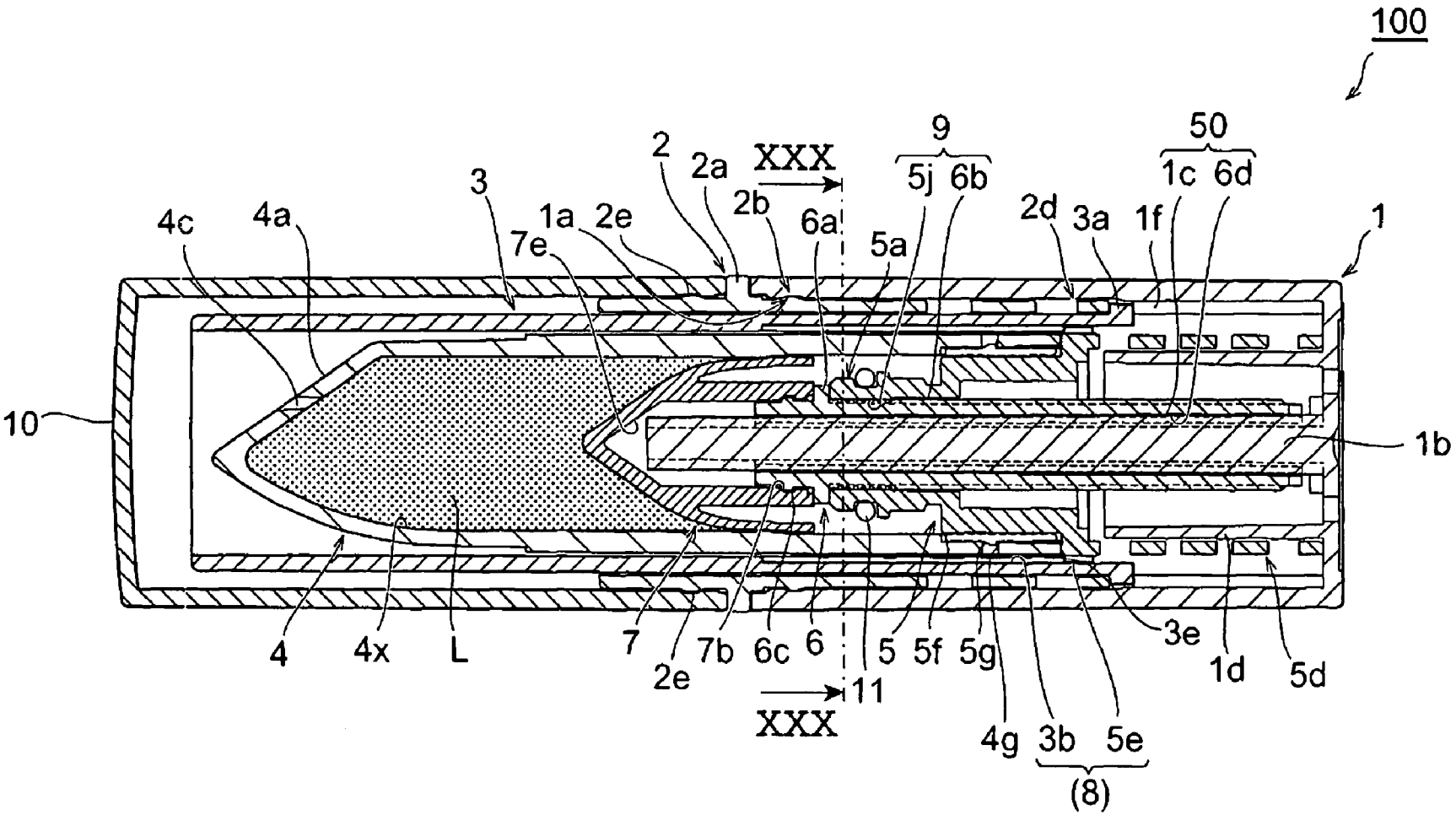
FIG. 1 is a longitudinal sectional view showing an applying filler extruding container in accordance with a first embodiment of the present invention.

A description will be given below of preferable embodiments of an applying filler extruding container in accordance with the present invention with reference to FIGS. 1 to 34. In this case, in each of the drawings, the same reference numerals are attached to the same elements and an overlapping description will be omitted.

Figure 14:
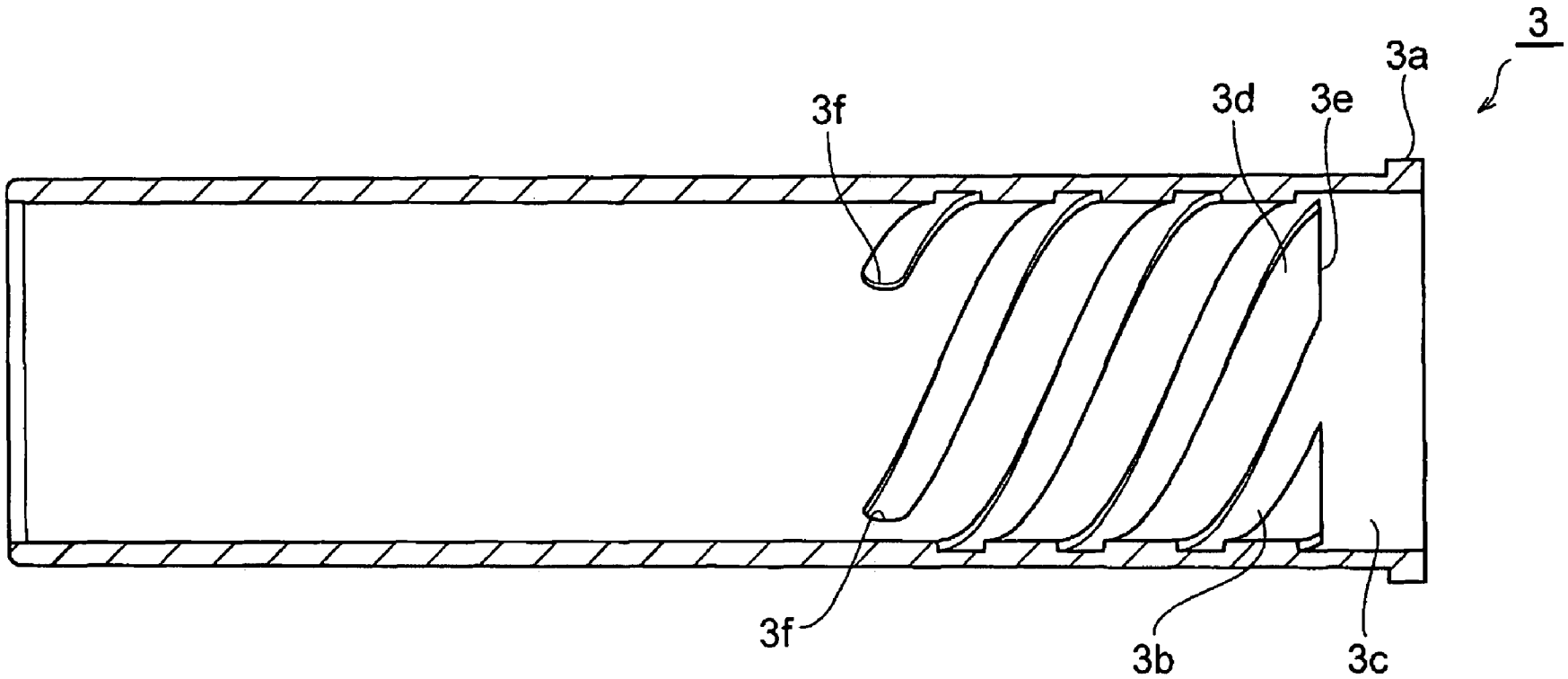
FIG. 14 is a longitudinal sectional view showing a leading tube in FIGS. 1 to 5.
Figure 23:
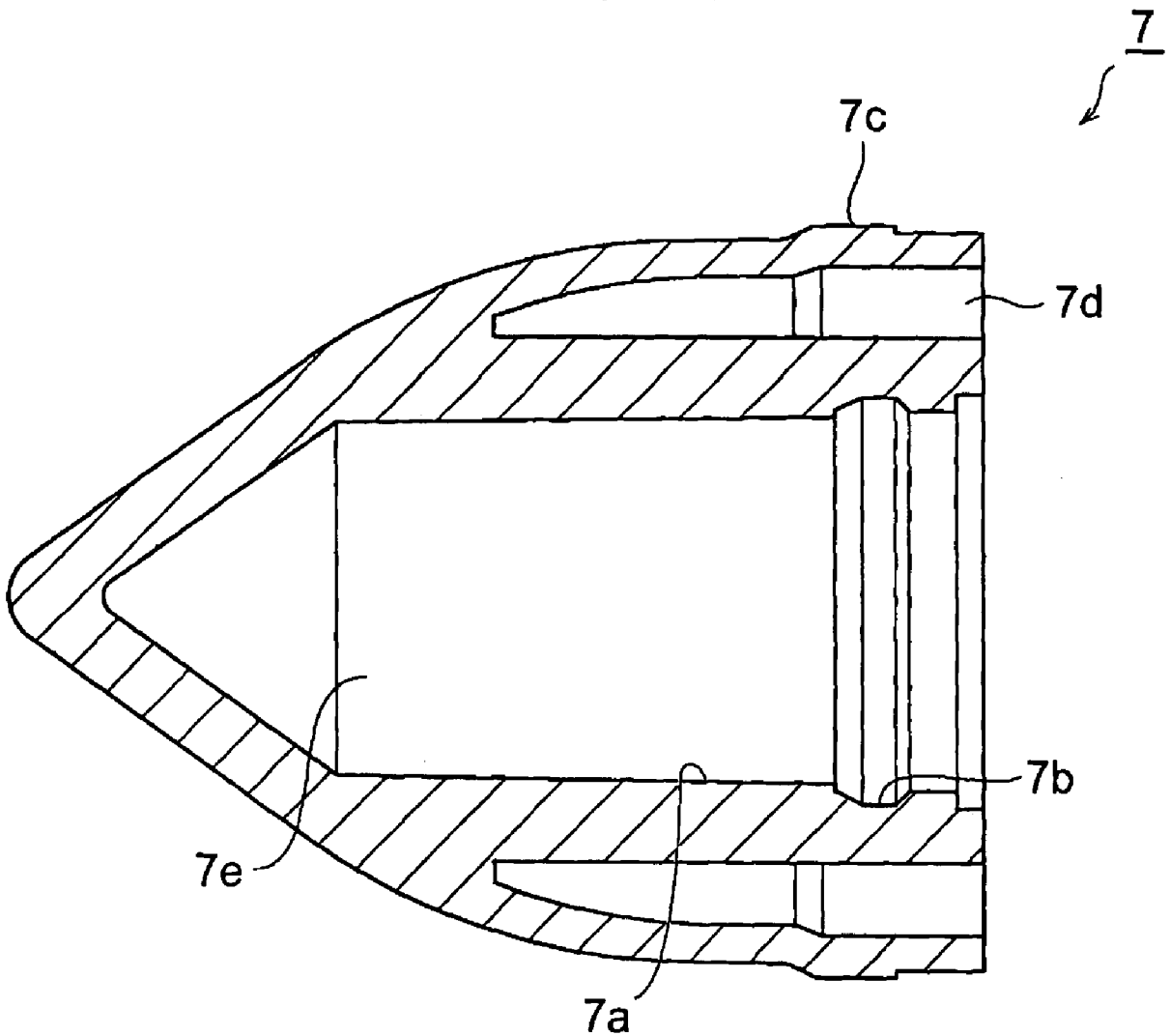
FIG. 23 is a longitudinal sectional view showing a piston in FIGS. 1 to 5.
Figure 24:
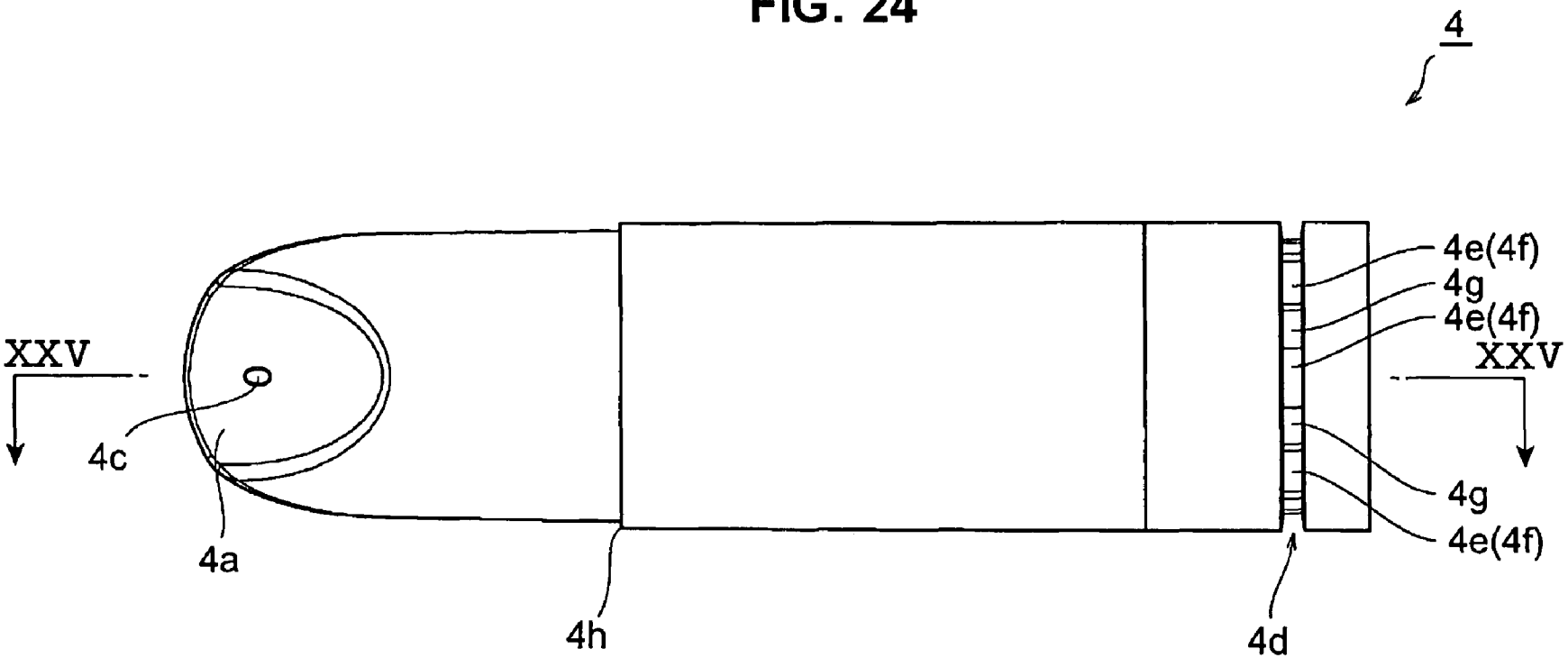
FIG. 24 is a side view showing a filling member in FIGS. 1 to 5.
Figure 25:
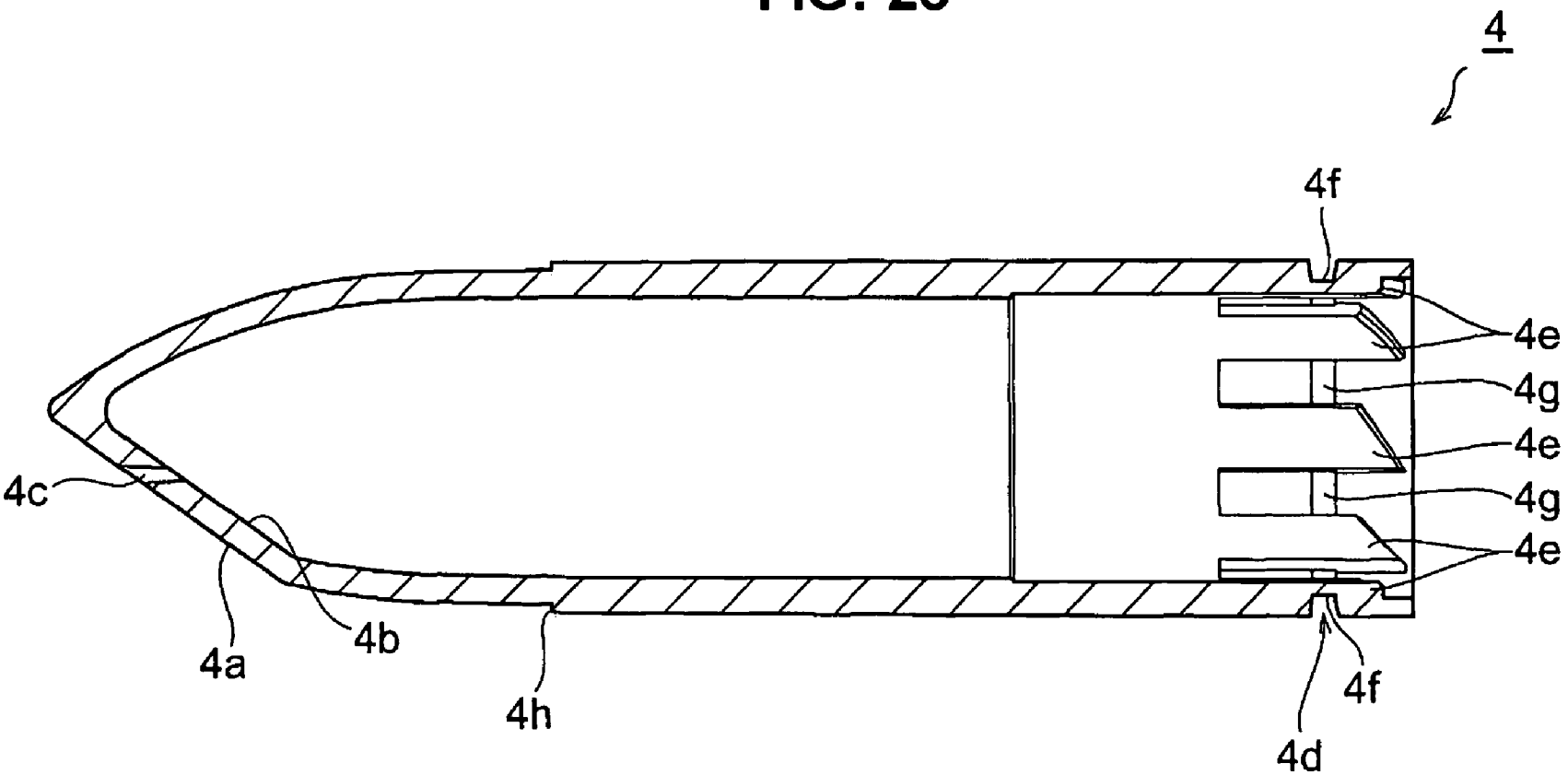
FIG. 25 is a view as seen from an arrow XXV—XXV in FIG. 24.
Figure 26:
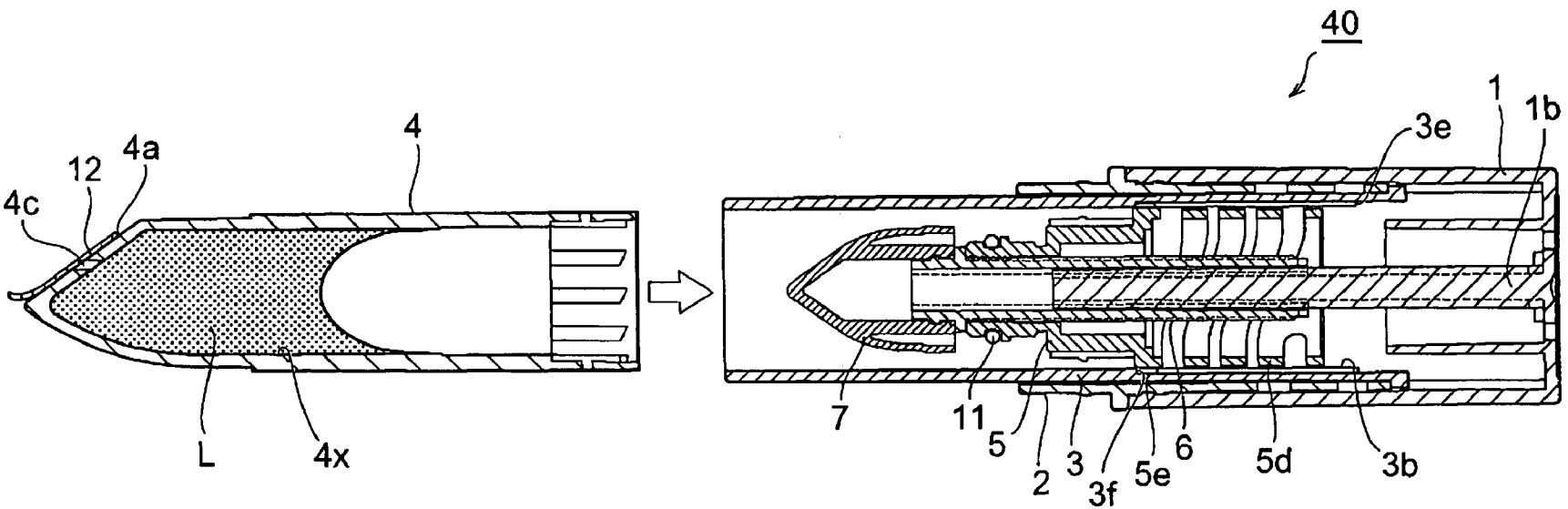
FIG. 26 is an exploded perspective view showing an assembling procedure of the applying filler extruding container in accordance with the first embodiment of the present invention.
Figure 27:
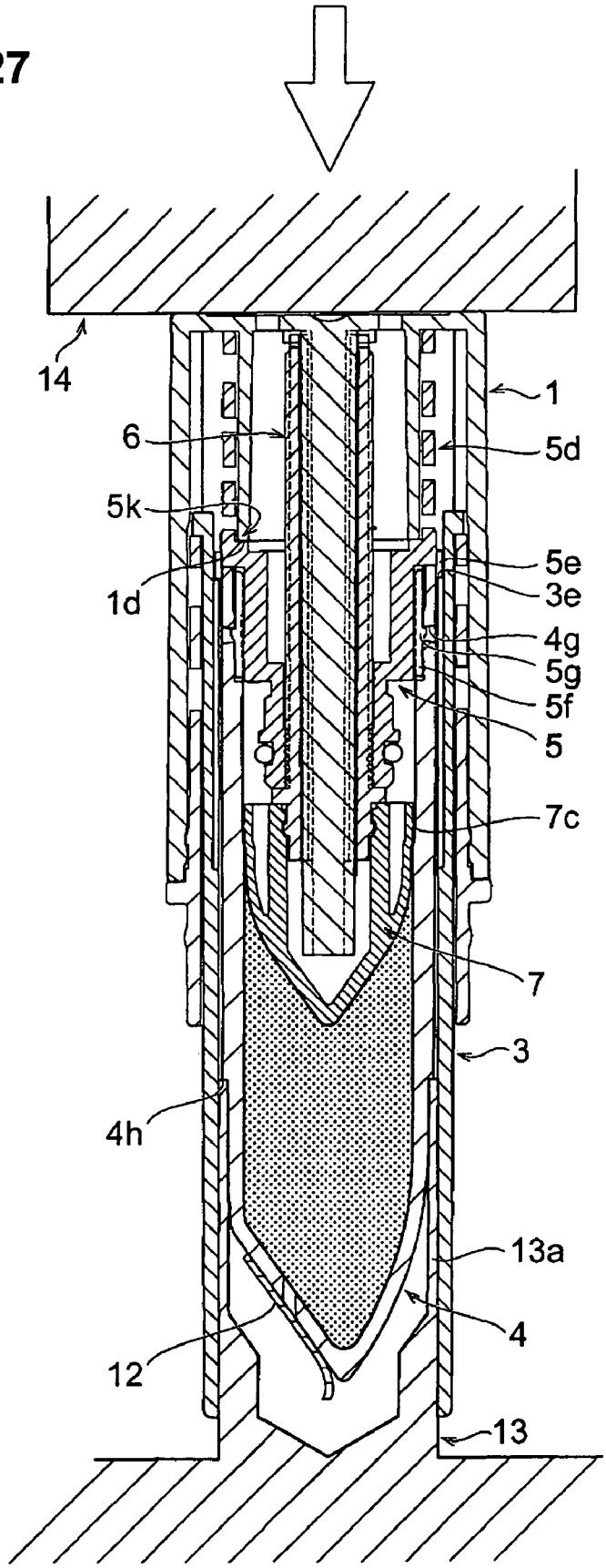
FIG. 27 is a state explanatory view showing an example at a time of installing the filling member to a main body side assembly.
Figure 28:
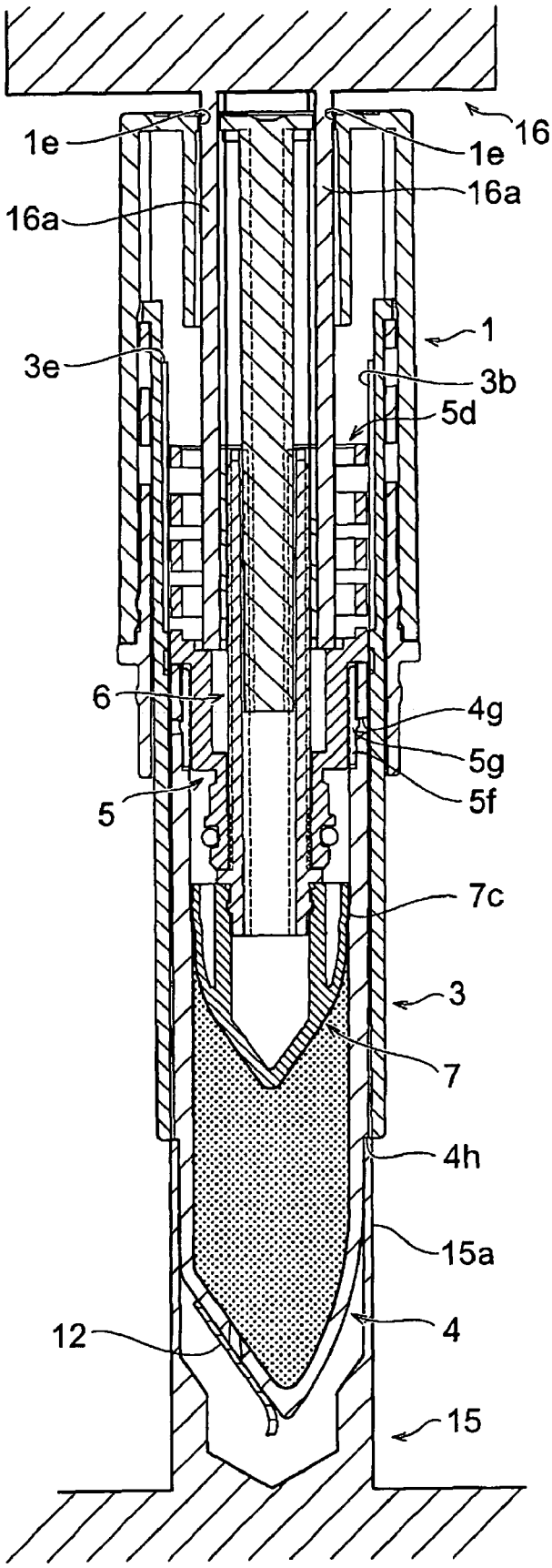
FIG. 28 is a state explanatory view showing another example at a time of installing the filling member to the main body side assembly.
Figure 29:
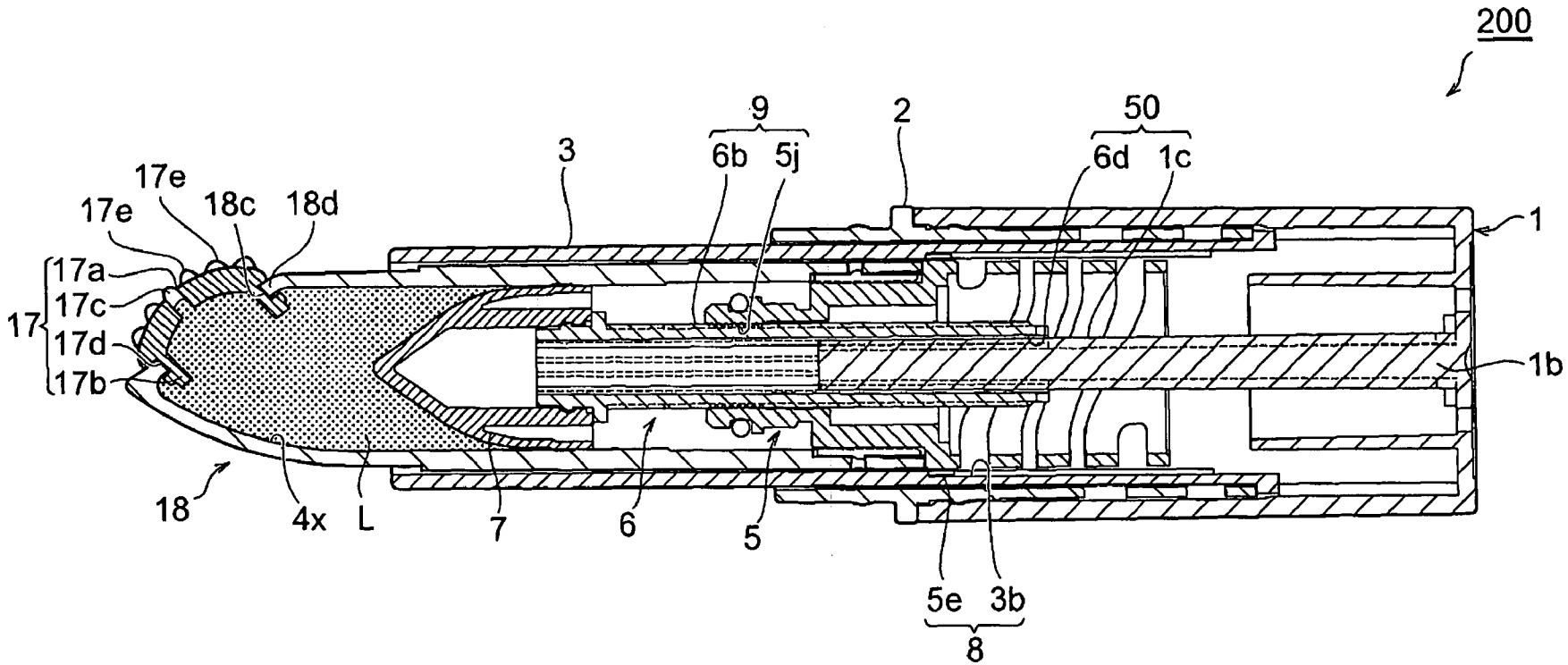
FIG. 29 is a longitudinal sectional view showing an applying filler extruding container in accordance with a second embodiment of the present invention, in a state that a filling member moves forward to the maximum on the basis of an operation of a user and a piston subsequently moves forward so as to be set in a used state.
Figure 30:
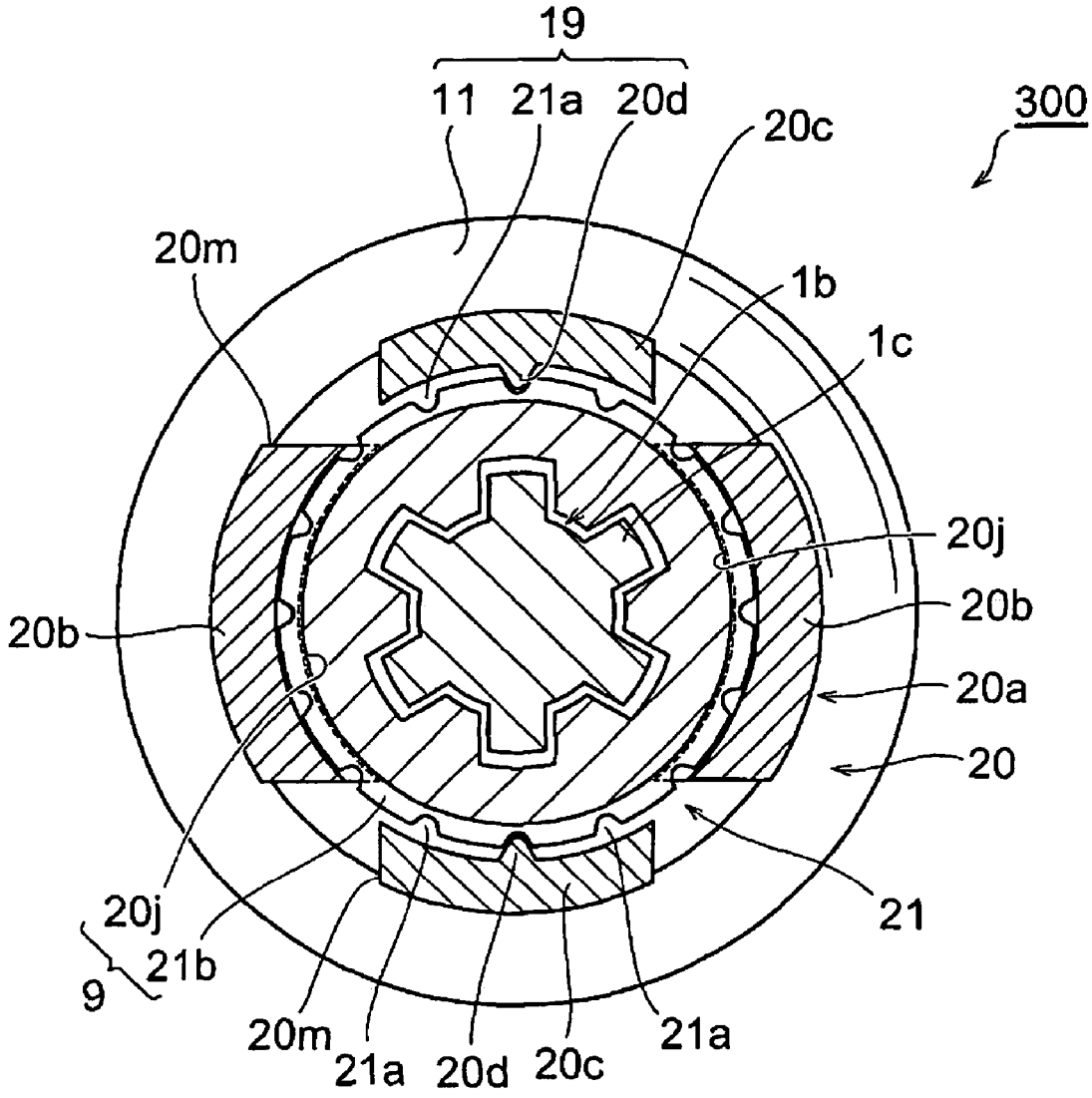
FIG. 30 is a transverse sectional view showing an applying filler extruding container in accordance with a third embodiment of the present invention, and is a view as seen from an arrow XXX—XXX in FIG. 1.
Figure 31:
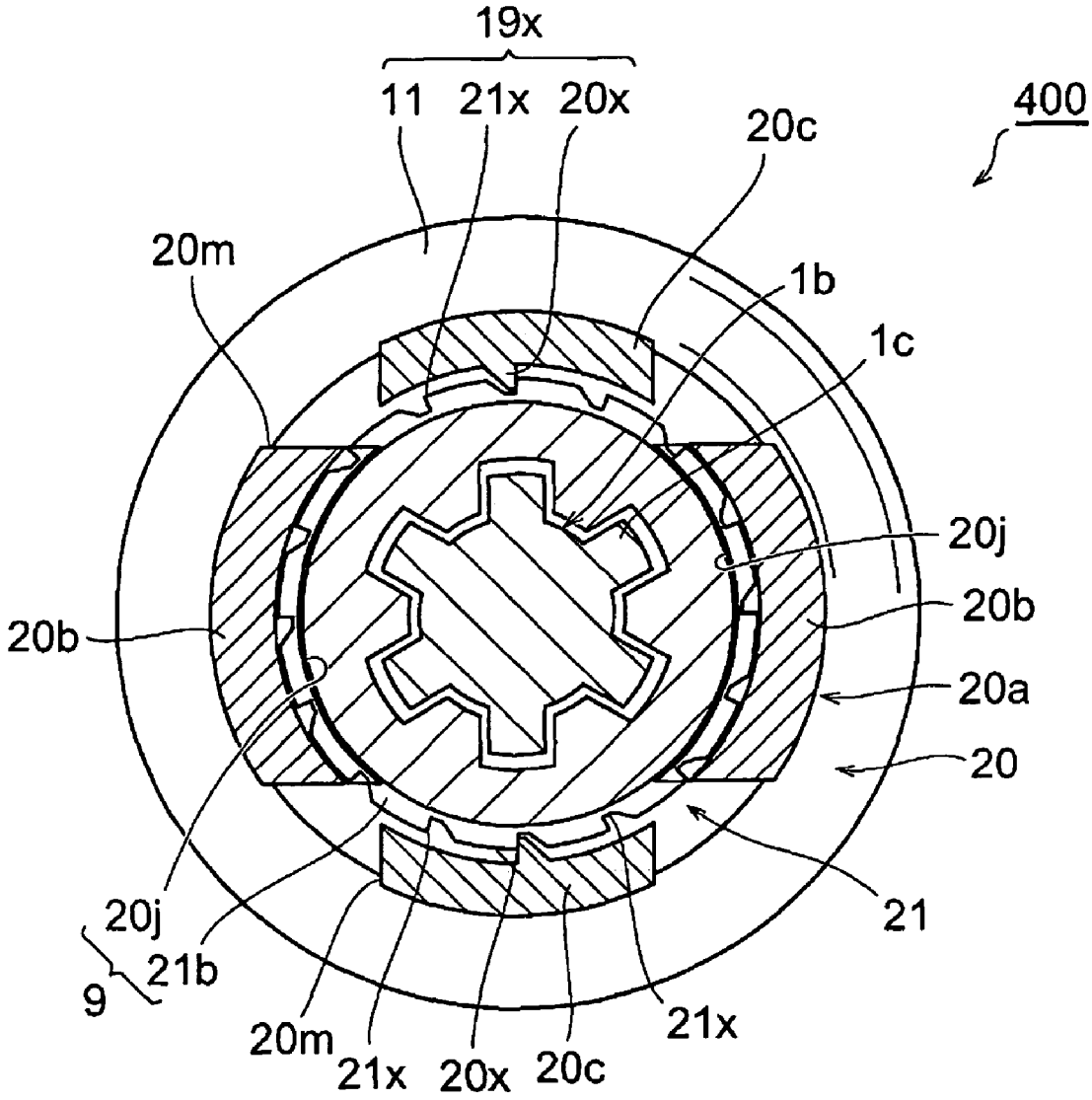
FIG. 31 is a transverse sectional view showing an applying filler extruding container in accordance with a fourth embodiment of the present invention, and is a corresponding view to FIG. 30.
Figure 32:
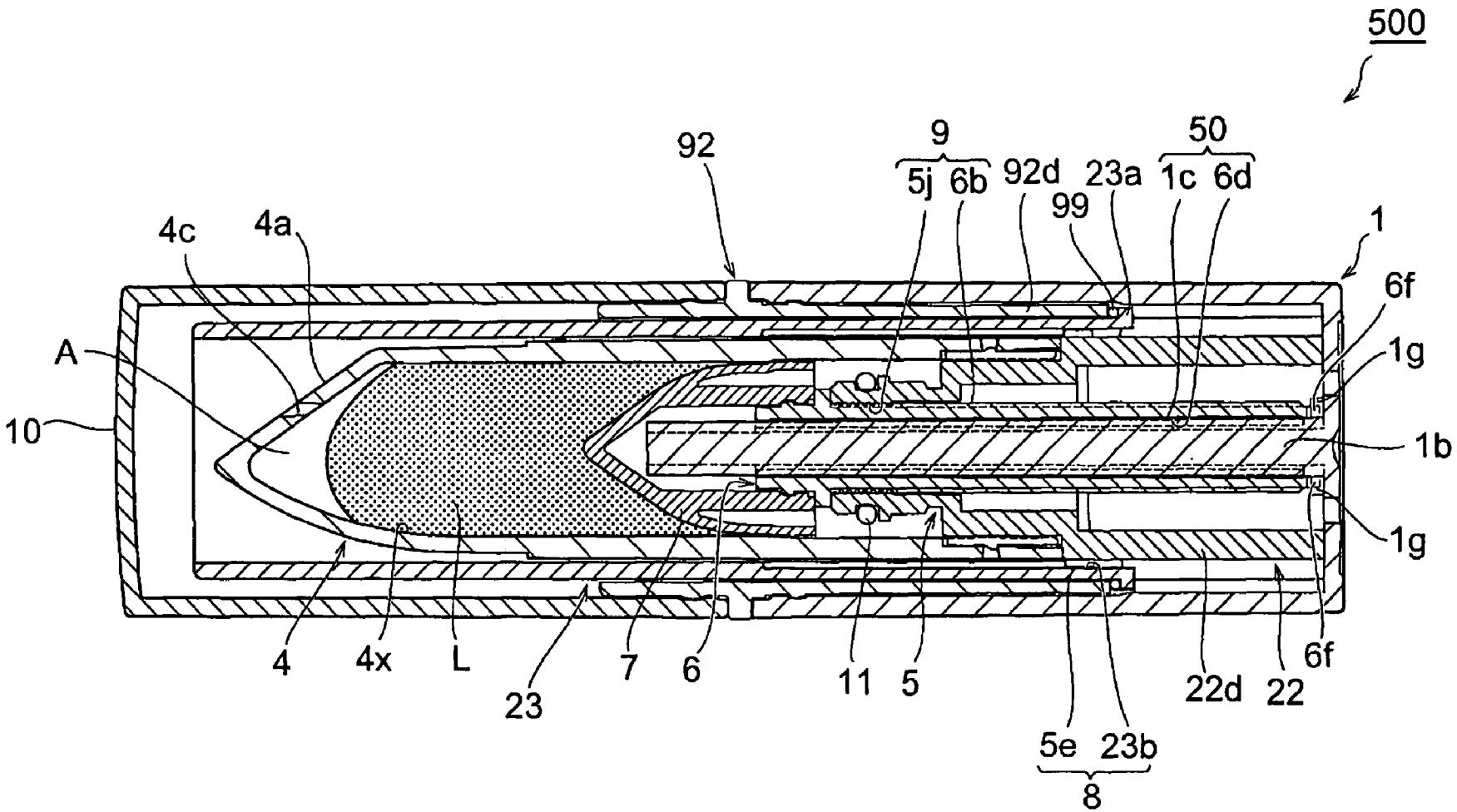
FIG. 32 is a longitudinal sectional view showing an applying filler extruding container in accordance with a fifth embodiment of the present invention, in a state that a filling member moves backward to the maximum on the basis of an operation after being used by a user and a piston subsequently moves backward to the maximum.
Figure 33:
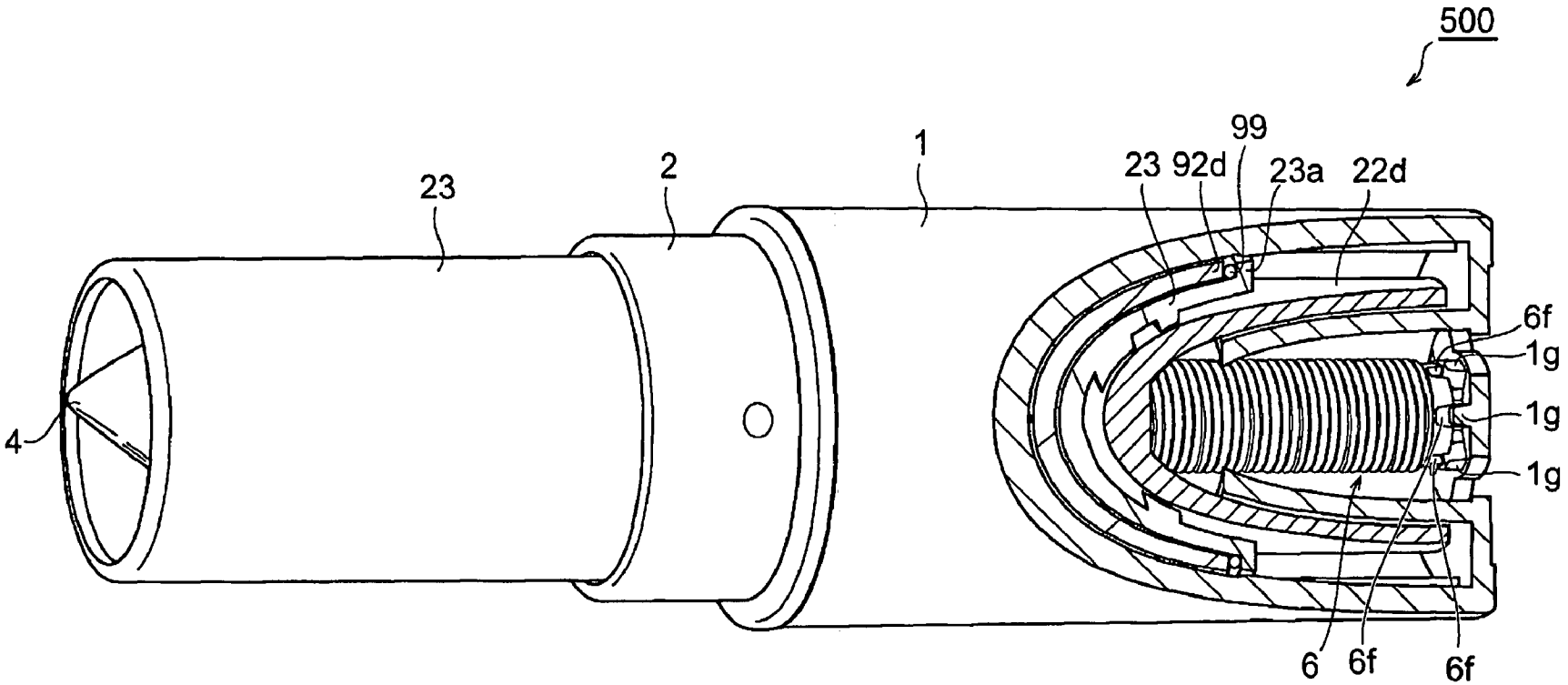
FIG. 33 is a partly broken perspective view showing the applying filler extruding container in accordance with the fifth embodiment of the present invention, in a state just before the filling member moves backward to the maximum on the basis of the operation after being used by the user and the piston subsequently moves backward to the maximum.
Figure 34:
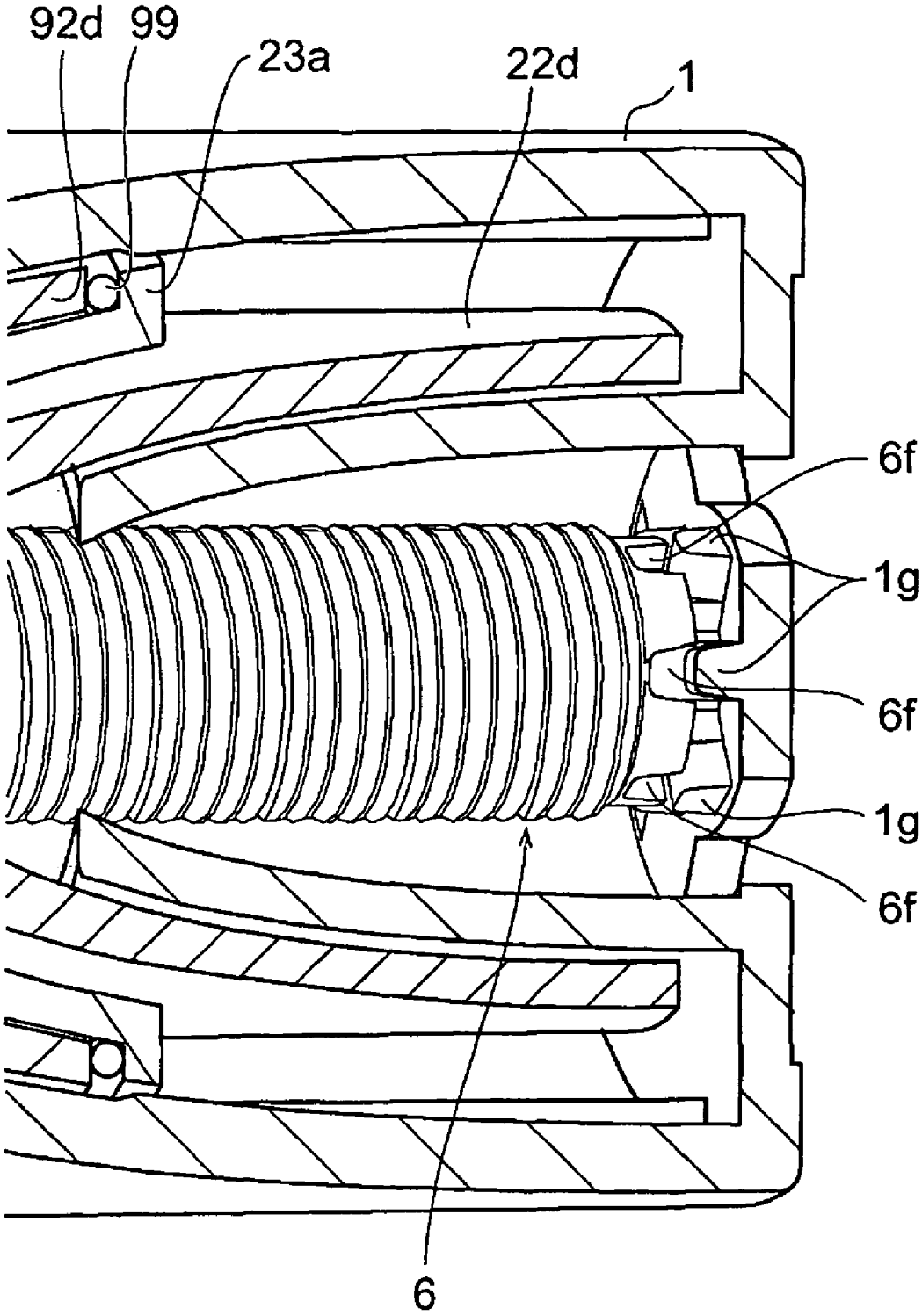
FIG. 34 is an enlarged view of a main portion in FIG. 33.

FIGS. 1 to 28 show a first embodiment in accordance with the present invention, FIG. 29 shows a second embodiment in accordance with the present invention, FIG. 30 shows a third embodiment in accordance with the present invention, FIG. 31 shows a fourth embodiment in accordance with the present invention, and FIGS. 32 to 34 show a fifth embodiment in accordance with the present invention, respectively. FIGS. 1 to 5 are respective longitudinal sectional views showing respective states of an applying filler extruding container in accordance with the first embodiment of the present invention, FIGS. 6 to 9 are respective views showing a main body tube, FIGS. 10 to 13 are respective views showing a leading tube pressing member, FIG. 14 is a view showing a leading tube, FIGS. 15 to 18 are respective views showing a piston movable body, FIGS. 19 to 22 are respective views showing a filling member movable body, FIG. 23 is a view showing a piston, FIGS. 24 and 25 are respective views showing a filling member, and FIGS. 26 to 28 are respective views showing an assembling procedure of the applying filler extruding container. The applying filler extruding container in accordance with the present embodiment accommodates the applying filler and can extrude appropriately on the basis of an operation of a user.

In this case, as the applying filler, it is possible to employ a liquid, a semisolid in jelly, gel, paste and kneaded product states, a soft solid and the like including, for example, a lip gloss, a lip color, an eye color, an eye liner, an essence, a cleaning solvent, a nail enamel, a nail care liquid solution, a nail enamel remover, a mascara, an anti-aging, a hair color, a hair cosmetic, an oral care, a massage oil, a keratotic plugging reducer, a foundation, a concealer, a skin cream, an ink for a writing instrument such as a marking pen and the like, a liquid drug medicine, a slurry and the like.

As shown in FIG. 1, an applying filler extruding container 100 is provided with a main body tube (a main body) 1 forming a rear half portion of the container, and a leading tube 3 forming a front half portion of the container and coupled to the main body tube 1 via a leading tube pressing member 2 so as to be relatively rotatable as an outer structure, and within the container, there are provided a filling member 4 having a filling region 4*x* in which an applying filler L is filled in an inner portion, a filling member movable body 5 coupling the filling member 4 so as to be non-rotatable and immobile in an axial direction and moving forward and backward when the main body tube 1 and the leading tube 3 are relatively rotated, a piston movable body (a movable body) 6 moving forward and backward in accordance with the forward and backward movement of the filling member movable body 5 and moving forward when the filling member 4 reaches a forward limit and the main body tube 1 and the leading tube 3 are further relatively rotated in the same direction, a piston 7 installed to a leading end portion of the piston movable body 6 and forming a rear end of the filling region 4*x*, a first meshing portion 8 (refer to FIGS. 2 to 4) enabling the movement of the filling member movable body 5, and a second meshing portion 9 enabling the movement of the piston movable body 6.

Figure 7:
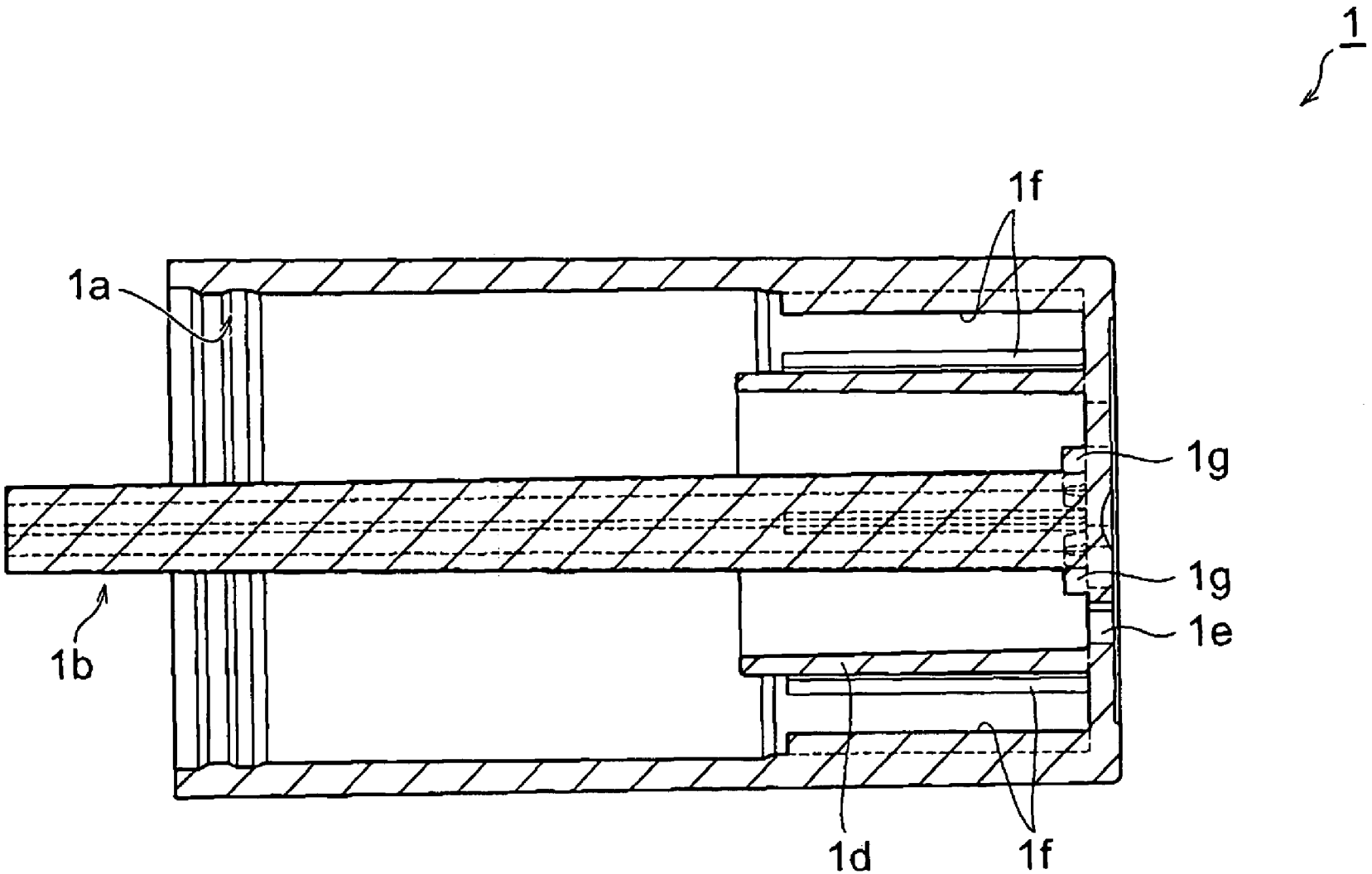
FIG. 7 is a longitudinal sectional view of the main body tube shown in FIG. 6.
Figure 8:
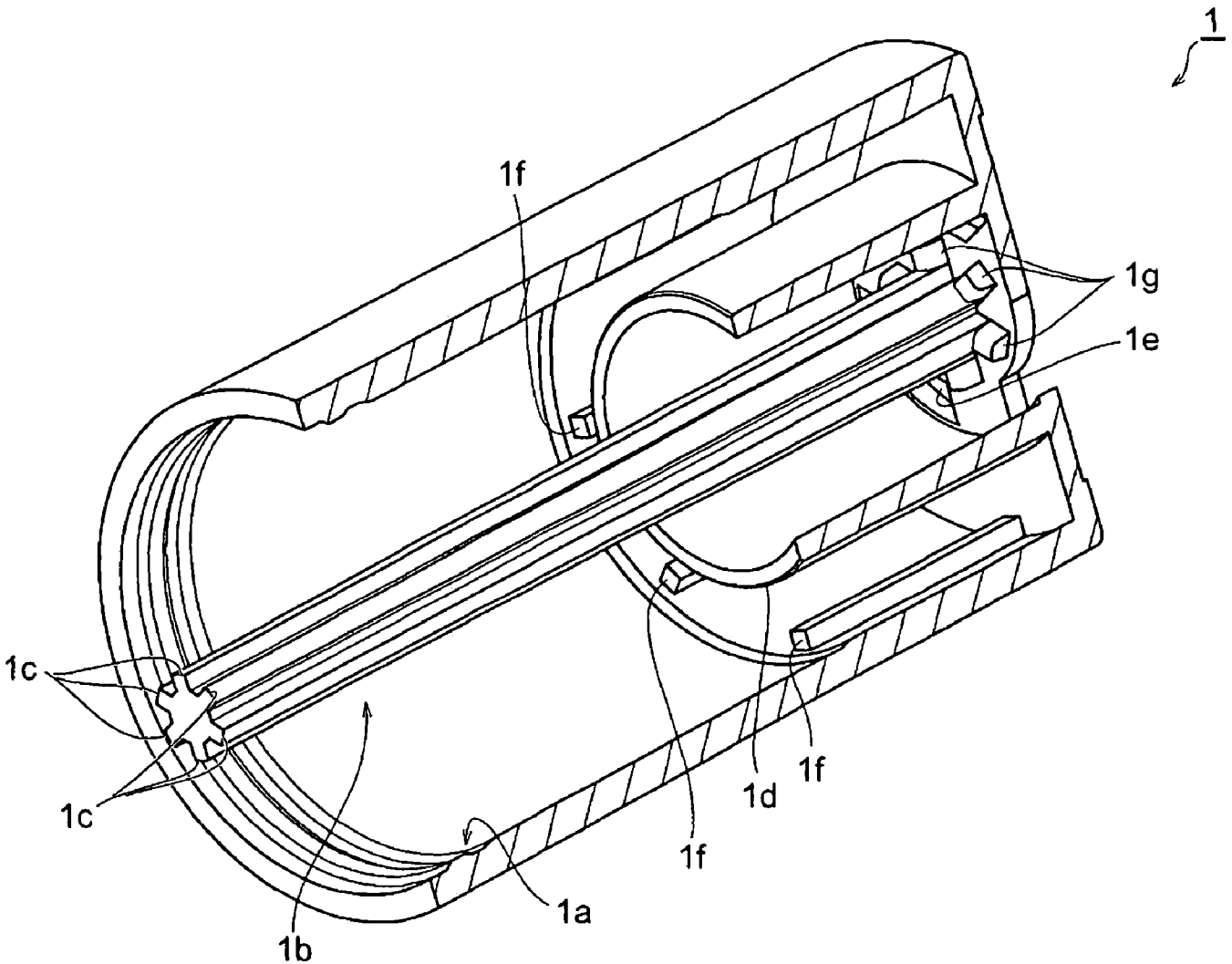
FIG. 8 is a sectional perspective view of the main body tube shown in FIG. 6.

The main body tube 1 is structured in a closed-end cylindrical shape as shown in FIGS. 6 to 9, and is provided with an annular concavo-convex portion 1*a* for installing the leading tube pressing member 2 in an inner peripheral surface in a leading end side thereof, as shown in FIGS. 7 and 8.

Figure 9:
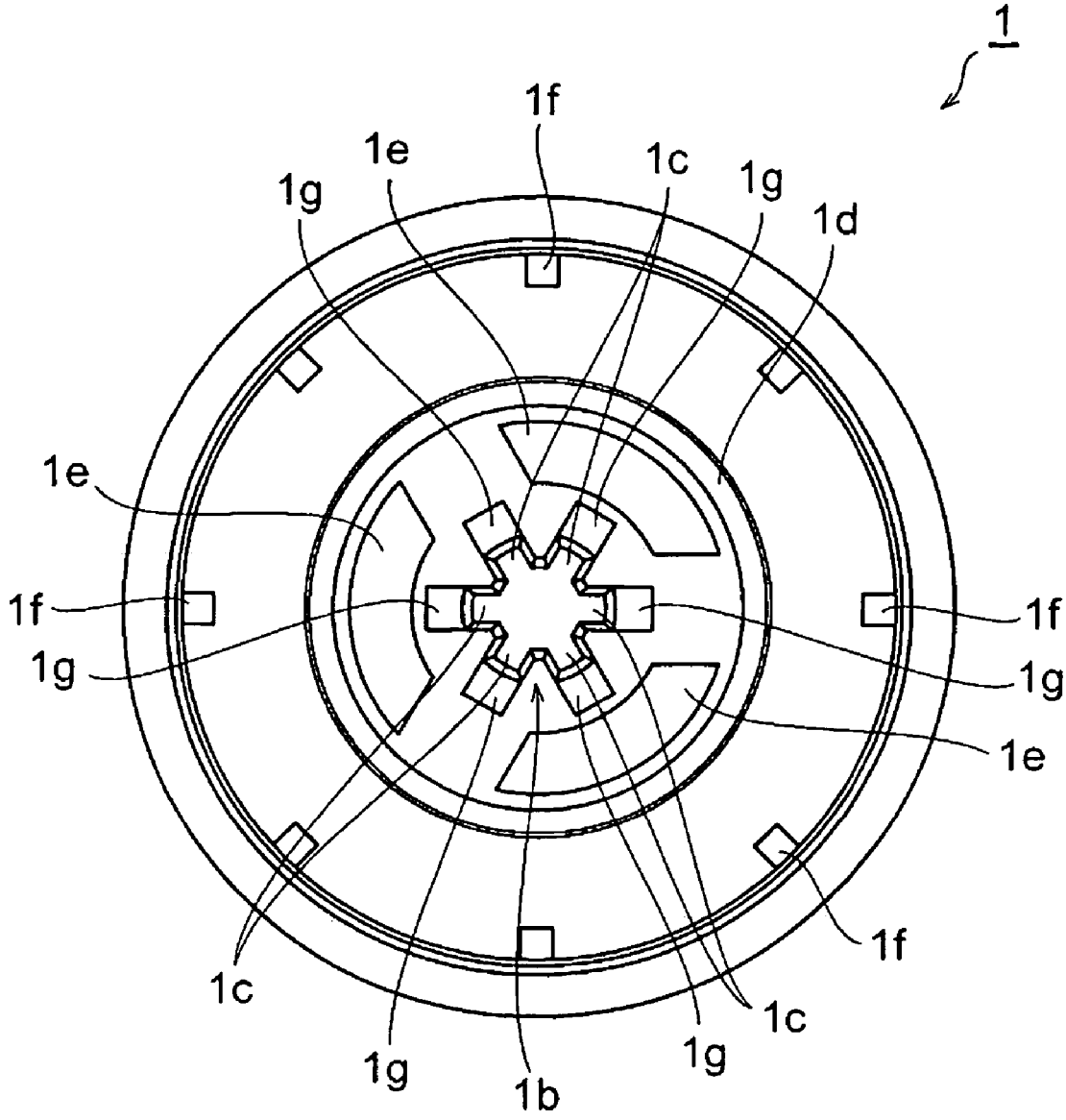
FIG. 9 is a left side view of the main body tube shown in FIG. 6.
Figure 10:
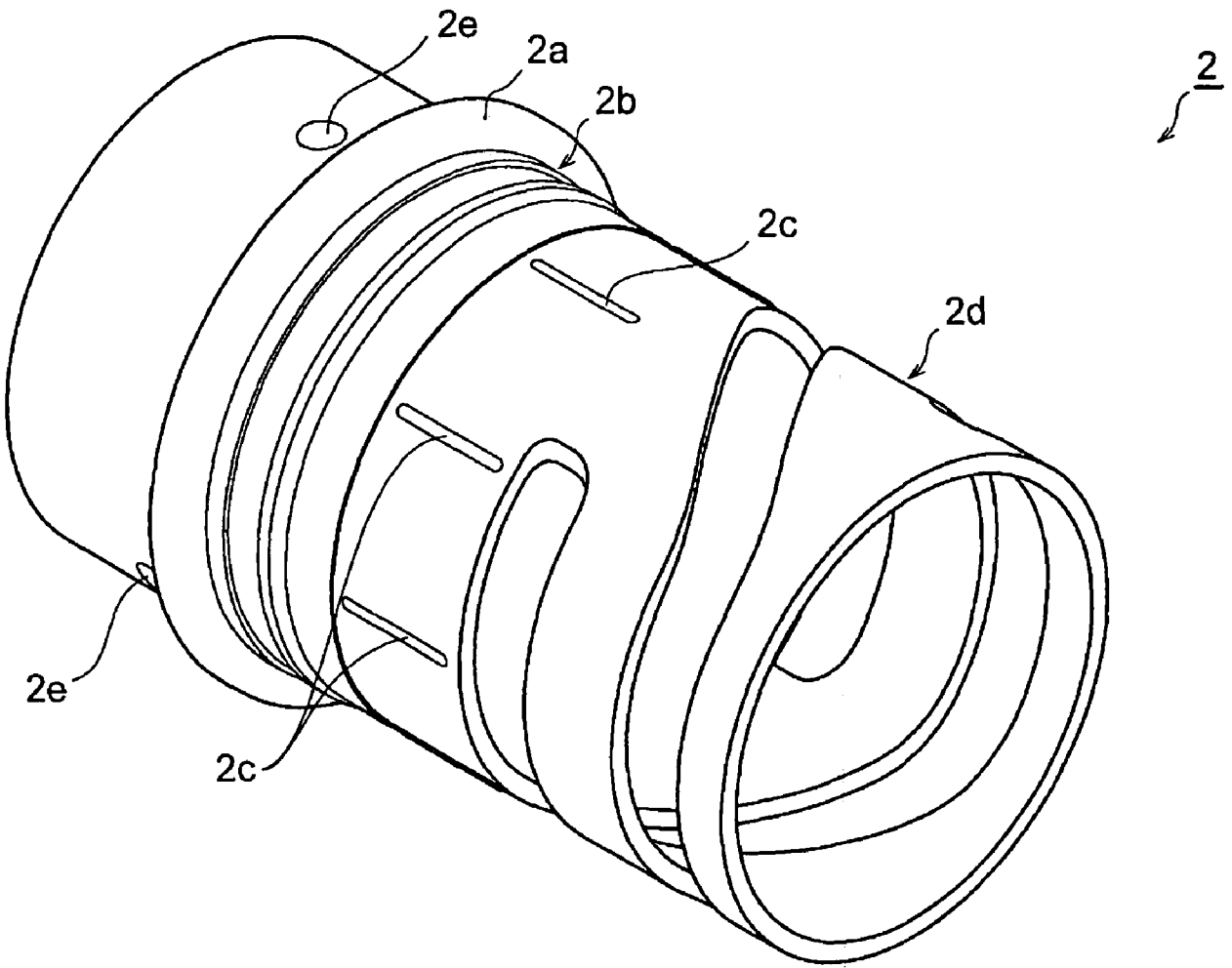
FIG. 10 is a perspective view showing a leading tube pressing member in FIGS. 1 to 5.
Figure 11:
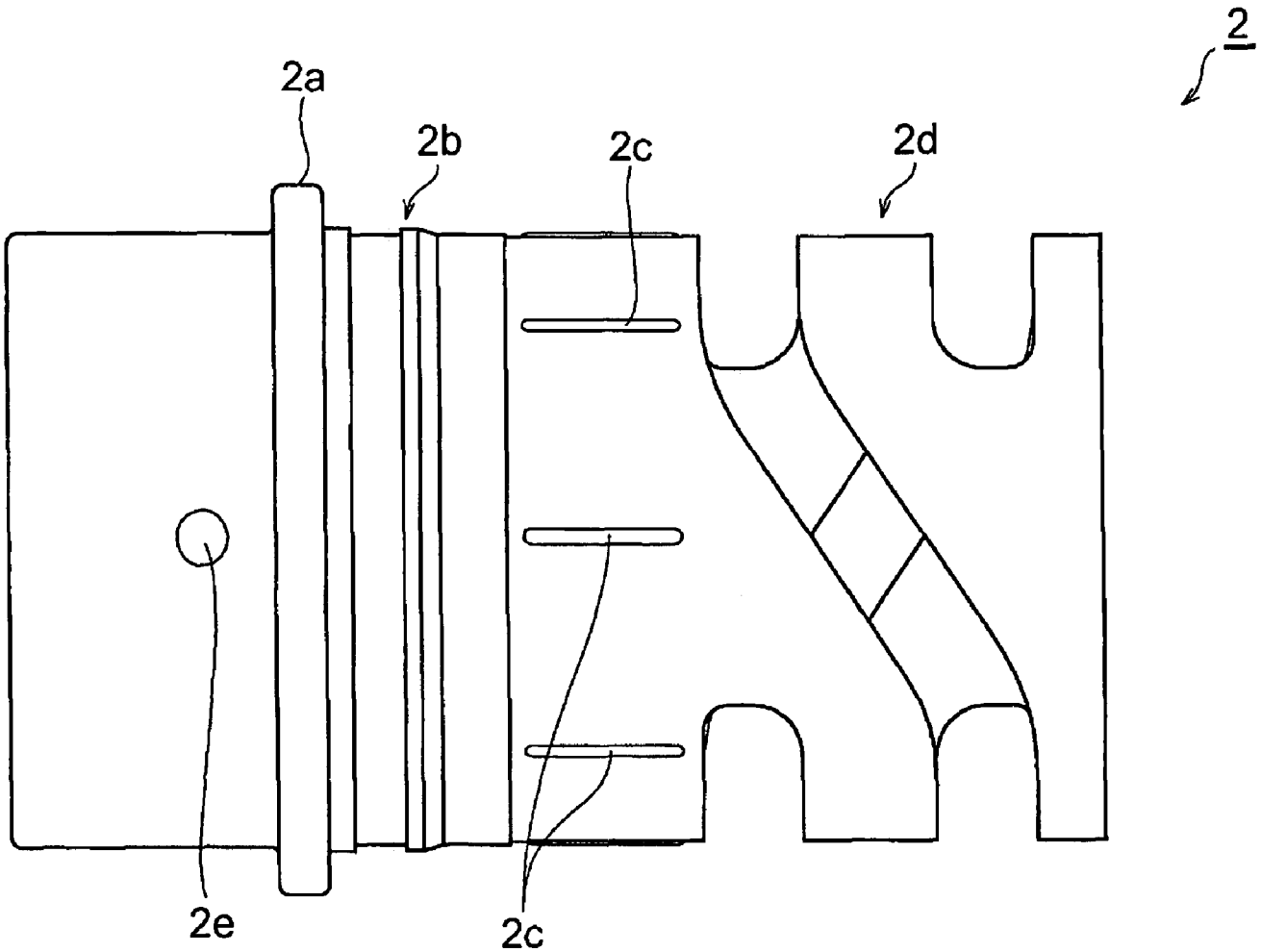
FIG. 11 is a side view showing the leading tube pressing member in FIGS. 1 to 5.
Figure 12:
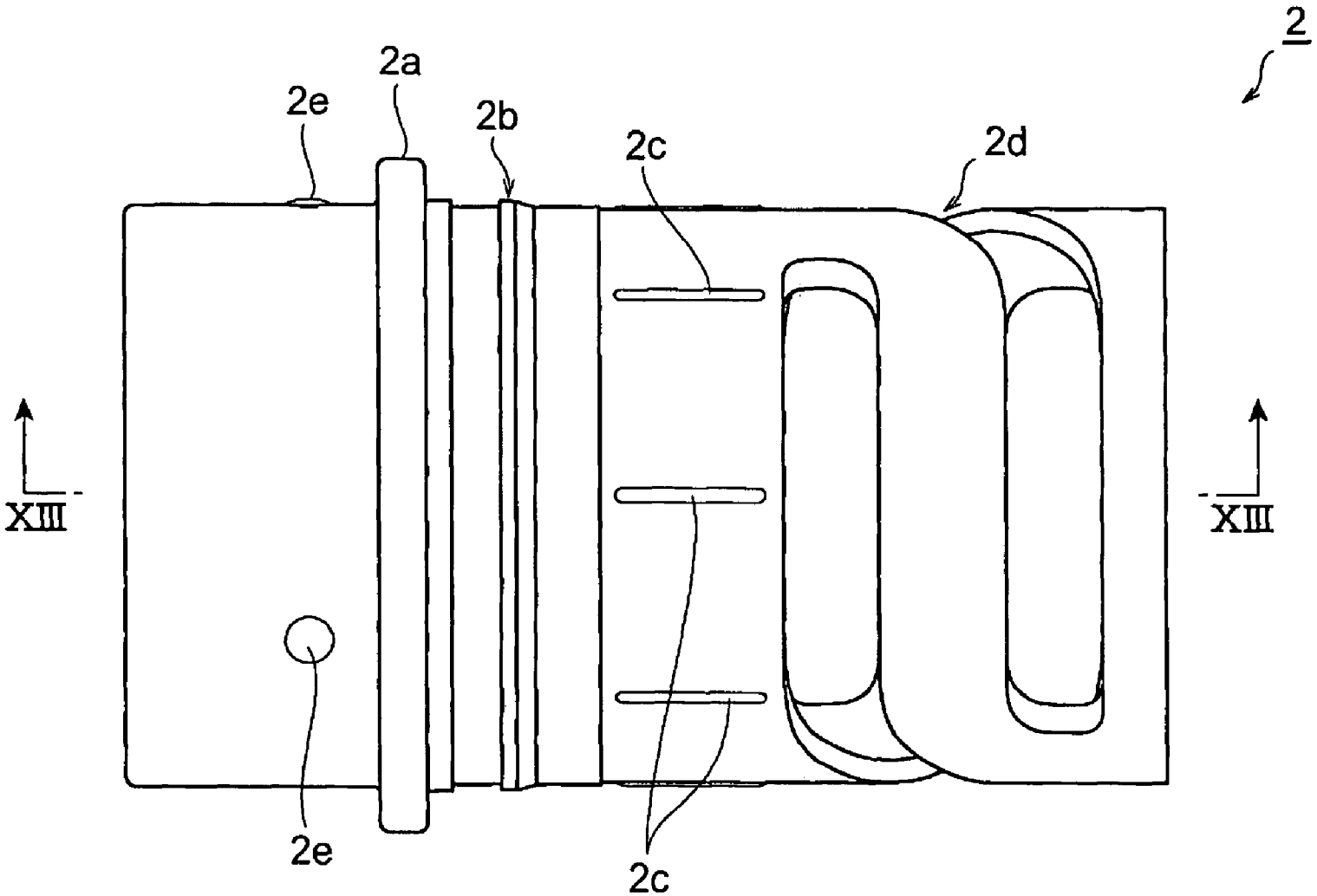
FIG. 12 is a bottom view of the leading tube pressing member shown in FIG. 11.
Figure 13:
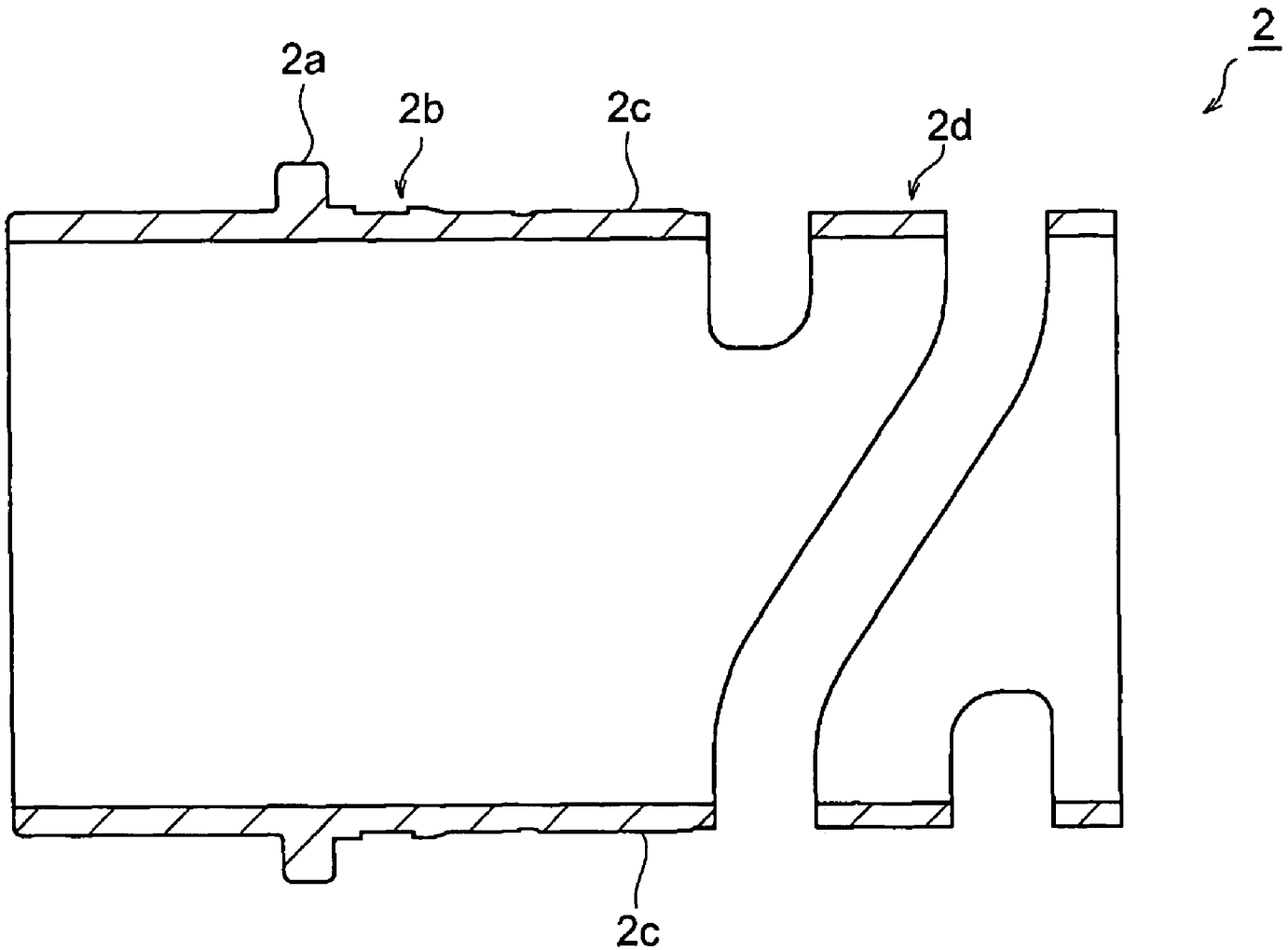
FIG. 13 is a view as seen from an arrow XIII—XIII in FIG. 12.

A shaft body 1*b* is provided in a rising manner in a center of a bottom portion in the main body tube 1 toward a leading end side, as shown in FIGS. 6 to 9. The shaft body 1*b* is formed to have a non-circular shape transverse section and provided with protrusions 1*c* arranged at six uniformly arranged positions along a peripheral direction so as to protrude to an outer side in a radial direction and extending in an axial direction, in an outer peripheral surface of a columnar body, and the protrusions 1*c* are formed as a rotation prevention constituting one side of a rotation preventing portion (rotation preventing mechanism) 50. A cylinder portion 1*d* extending to the middle in the axial direction of the main body tube 1 is provided in a rising manner in a bottom portion of the main body tube 1 so as to surround the shaft body 1*b*. Further, as shown in FIGS. 8 and 9, an opening 1*e* for inserting an assembling jig mentioned below is provided at three uniformly arranged positions along the peripheral direction, in a bottom portion between the cylinder portion 1*d* and the shaft body 1*b* in the main body tube 1.

The main body tube 1 is provided with protrusions 1*f* extending to approximately the same level as that of the cylinder portion 1*d* toward the leading end side from the bottom portion at eight uniformly arranged positions along the peripheral direction, in an inner peripheral surface of the main body tube 1, as shown in FIGS. 6 to 9. The protrusion 1*f* is provided for bringing a rear end surface of the leading tube 3 into contact therewith. In this case, a structure around the shaft body 1*b* in the bottom portion of the main body tube 1 will be described in a fifth embodiment.

The leading tube 3 is structured in a cylindrical shape having a collar portion 3*a* in a rear end portion, as shown in FIG. 14, and is provided with a spiral groove (a tube side thread) 3*b* serving as a female thread constituting one side of a first meshing portion (meshing mechanism) 8 to a portion near a rear end portion from an approximate middle in the axial direction, in an inner peripheral surface of the leading tube 3. A leading end 3*f* of the spiral groove 3*b* of the leading tube 3 is set as a forward limit of a meshing projection 5*e* mentioned below, and corresponds to a forward limit of the filling member 4.

A diameter of an inner peripheral surface 3*c* extending to a rear end of the leading tube 3 from a rear end of the spiral groove 3*b* in the leading tube 3 is set to be same as a diameter of the spiral groove 3*b*, the inner peripheral surface 3*c* and the rear end of the spiral groove 3*b* are flush connected, and the inner peripheral surface 3*c* is structured such as to have a step surface 3*e* where the inner peripheral surface 3*d* side becomes higher (an inner diameter in the inner peripheral surface 3*d* side becomes smaller), in a boundary portion between the inner peripheral surface 3*c* and the inner peripheral surface 3*d* in front of the inner peripheral surface 3*c* and except the spiral groove 3*b*.

The leading tube 3 is structured, as shown in FIG. 1, such that a rear half portion is inserted inside the main body tube 1, and a rear side surface of the collar portion 3*a* is brought into contact with a leading end surface of the protrusion 1*f* of the main body tube 1.

The leading tube pressing member 2 is constituted by an injection molded product by a resin, and is structured in a cylinder shape having a collar portion 2*a* in a leading end side. The leading tube pressing member 2 is provided with an annular concavo-convex portion 2*b* for engaging with an annular concavo-convex portion 1*a* of the main body tube 1 in an axial direction in an outer peripheral surface in rear side from the collar portion 2*a*, and is provided with protrusions 2*c* extending in an axial direction for being brought into contact with an inner peripheral surface of the main body tube 1 at eight uniformly arranged positions along a peripheral direction in an outer peripheral surface in a rear side from the annular concavo-convex portion 2*b*. The cylinder portion in the rear side from the protrusion 2*c* is formed as a spring portion 2*d* freely expanding and contracting in an axial direction so as to be integrally formed with a front side portion thereof. Further, the leading tube pressing member 2 is provided with protruding portions (so-called dowels) 2*e* for detachably locking a cap 10 shown in FIG. 1 in the axial direction at three uniformly arranged positions along a peripheral direction on an outer peripheral surface in a front side from the collar portion 2*a*.

In the leading tube pressing member 2, as shown in FIG. 1, the rear side portion from the collar portion 2*a* is inserted inside the main body tube 1 and is fitted outside the leading tube 3, the rear end surface of the collar portion 2*a* is brought into contact with the leading end surface of the main body tube 1, and the annular concavo-convex portion 2*b* is engaged with the annular concavo-convex portion 1*a* of the main body tube 1, whereby the leading tube pressing member 2 is installed to the main body tube 1 so as to be relatively non-rotatable (or relatively rotatable) and be immobile in the axial direction.

In this state, the front side surface of the collar portion 3*a* in the leading tube 3 is pressed against the rear end surface of the leading tube pressing member 2 so as to be energized to the rear side by the spring portion 2*d* of the leading tube pressing member 2, and the collar portion 3*a* is installed to the main body tube 1 so as to be relatively rotatable via the leading tube pressing member 2 in such a manner that the collar portion 3*a* is pinched between the leading tube pressing member 2 and the protrusion 1*f* of the main body tube 1. Accordingly, a better rotational resistance is generated in the leading tube 3 and the main body tube 1.

Figure 15:
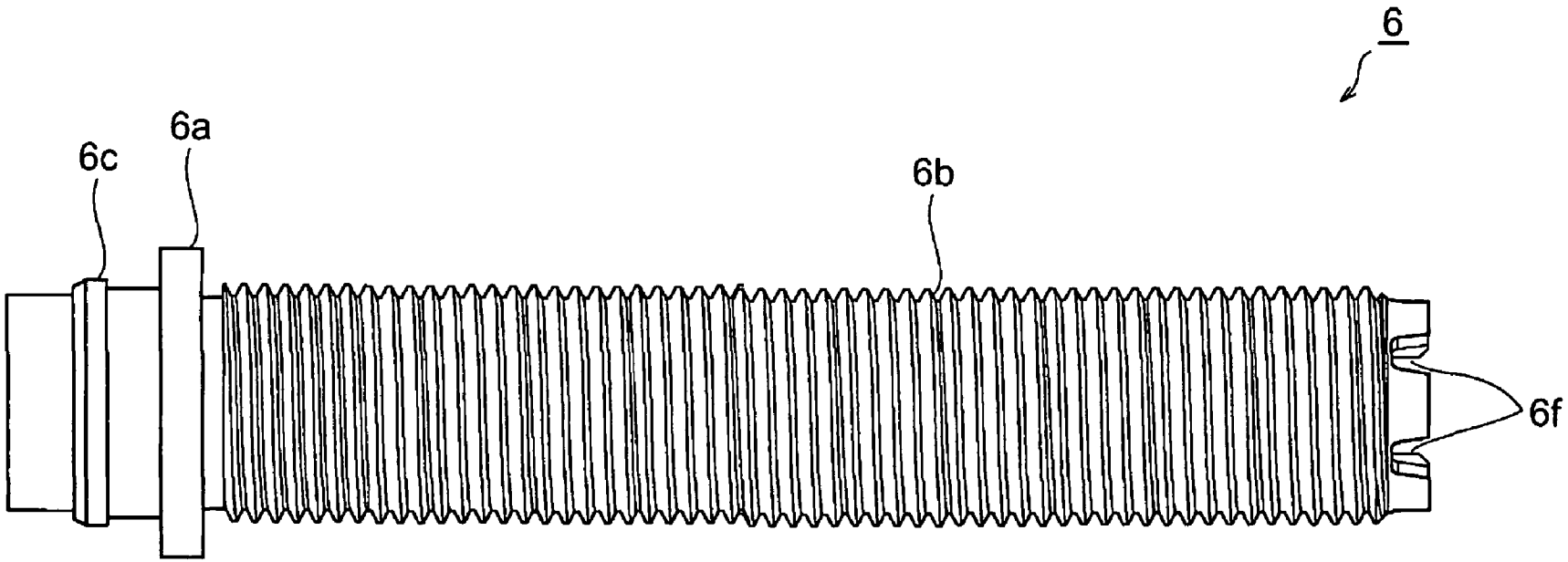
FIG. 15 is a side view showing a piston movable body in FIGS. 1 to 5.
Figure 16:
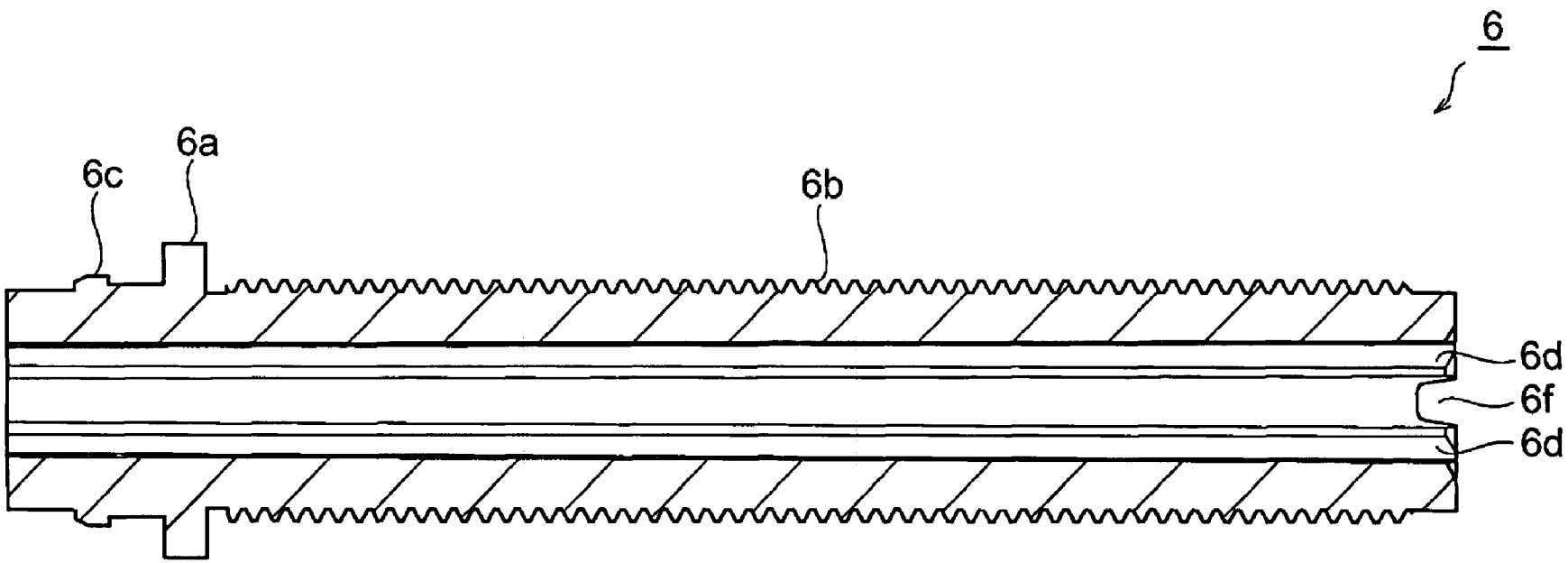
FIG. 16 is a longitudinal sectional view of the piston movable body shown in FIG. 15.
Figure 17:
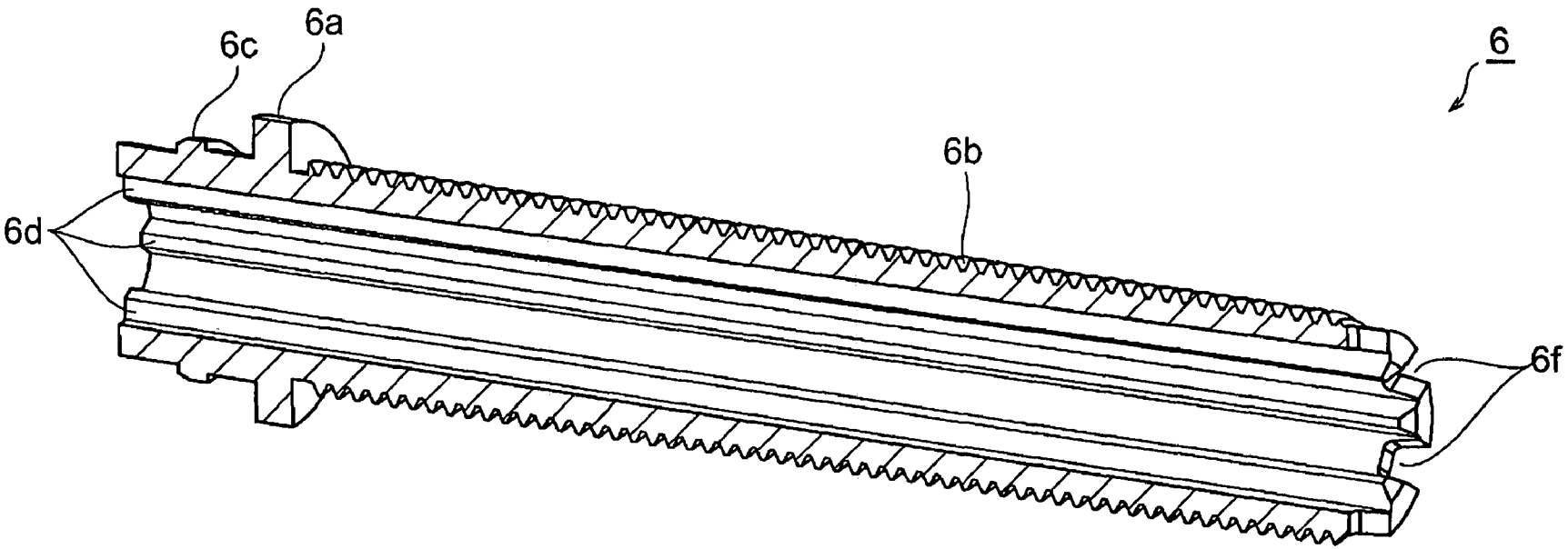
FIG. 17 is a longitudinal sectional perspective view of the piston movable body shown in FIG. 15.
Figure 18:
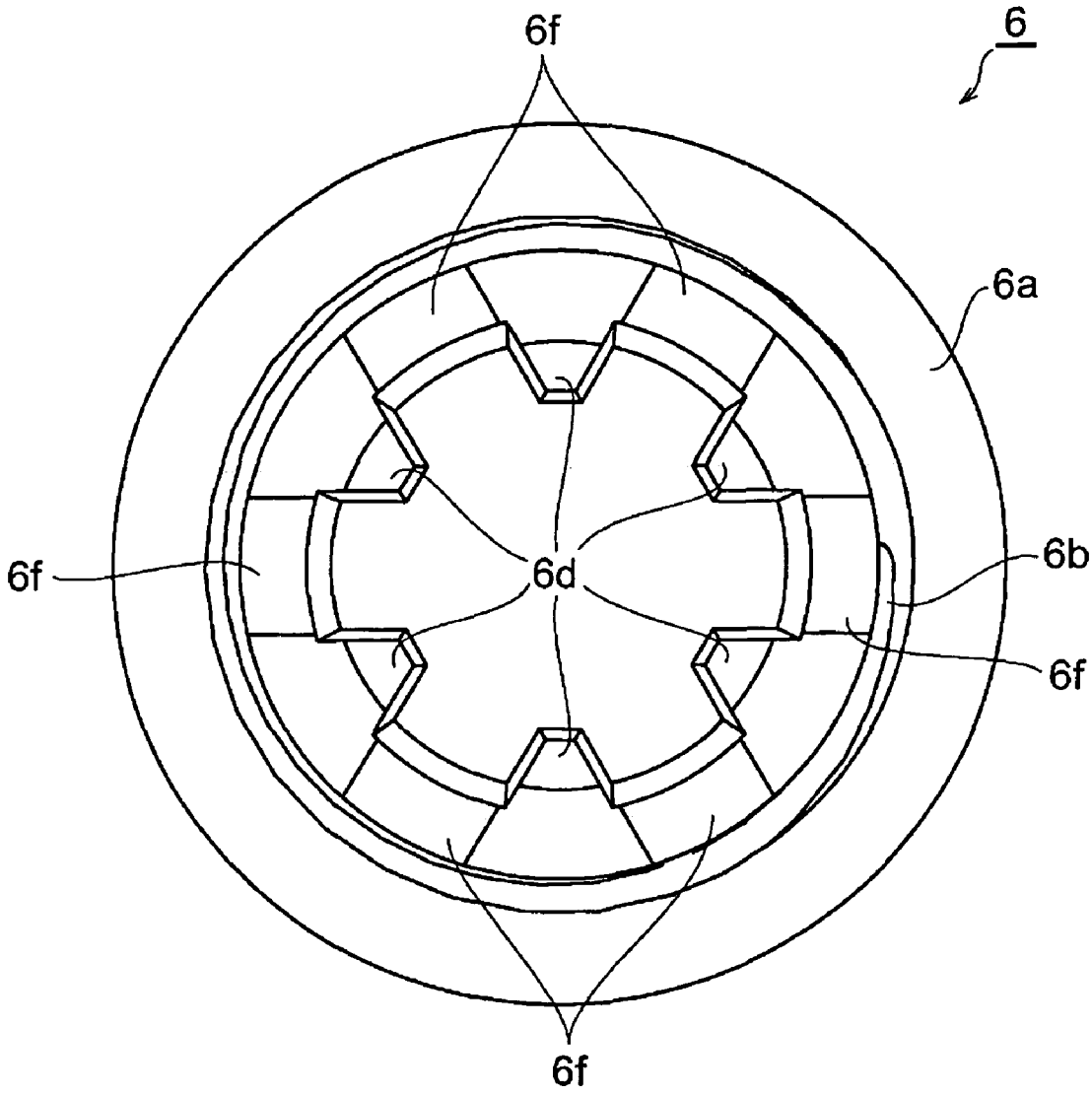
FIG. 18 is a right side view of the piston movable body shown in FIG. 15.

The piston movable body 6 is structured in a cylindrical shape having a collar portion 6*a* in a leading end side, as shown in FIGS. 15 to 17, and is provided with a male thread 6*b* constituting one side of a second meshing portion (meshing mechanism) 9 on an outer peripheral surface extending to a rear end portion from a rear side of the collar portion 6*a*. Further, an annular protruding portion 6*c* for installing the piston 7 is formed in an outer peripheral surface in a front side from the collar portion 6*a* of the piston movable body 6. Further, as shown in FIGS. 16 to 18, an inner peripheral surface extending to a rear end from a leading end of the piston movable body 6 is provided with protrusions 6*d* arranged so as to radially protrude to an inner side and extending in an axial direction at six uniformly arranged positions along a peripheral direction, and the protrusion 6*d* is constituted as a rotation prevention structuring the other side of the rotation preventing portion (the rotation preventing mechanism) 50. In this case, a structure of the rear end portion of the piston movable body 6 will be mentioned in a fifth embodiment.

The piston movable body 6 is fitted outside the shaft body 1*b* of the main body tube 1, as shown in FIG. 1, and the protrusion 6*d* thereof is engaged with a portion between the protrusions 1*c* and 1*c* of the shaft body 1*b* of the main body tube 1, whereby the piston movable body 6 is installed to the main body tube 1 so as to be non-rotatable and be movable in the axial direction.

The piston 7 is formed by a resin, for example, a plastic or the like, is formed in a bell shape extending toward a leading end taperingly, is provided with a concave portion 7*a* extending at a predetermined length toward a leading end side from an approximate middle of the rear end surface, and is provided with an annular groove portion 7*b* for engaging with the annular protruding portion 6*c* of the piston movable body 6 in the axial direction in a rear portion side of the concave portion 7*a*.

The piston 7 is provided with an annular protruding portion 7*c* closely contacted with the inner peripheral surface of the filling member 4 so as to secure a water tightness, in an outer peripheral surface of a rear end portion, and is provided with an annular convex portion 7*d* extending at a predetermined length toward a leading end side from a rear end surface at a position around the concave portion 7*a*. The annular concave portion 7*d* facilitates a deformation of the outer peripheral side portion from the annular concave portion 7*d* in the piston 7 toward the axis (toward the inner side) at a time when the annular protruding portion 7*c* moves while being in close contact with the inner peripheral surface of the filling member 4, and is provided for making the piston 7 move without being affected from an excessive resistance from the inner peripheral surface of the filling member 4.

The piston 7 is fitted outside the piston movable body 6 as shown in FIG. 1, a rear end surface thereof is brought into contact with a front side surface of the collar portion 6*a* of the piston movable body 6, and the annular groove portion 7*b* is engaged with the annular protruding portion 6*c* of the piston movable body 6, whereby the piston 7 is installed to the movable body 6 so as to be rotatable (or non-rotatable) and be immobile in the axial direction. In this state, a space 7*e* for accommodating the leading end portion of the shaft body 1*b* of the main body tube 1 entered into the concave portion 7*a* is defined in a front half portion of the concave portion 7*a* of the piston 7. In this case, the piston movable body 6 and the piston 7 can be integrally formed so as to be in one rod shape.

Figure 19:
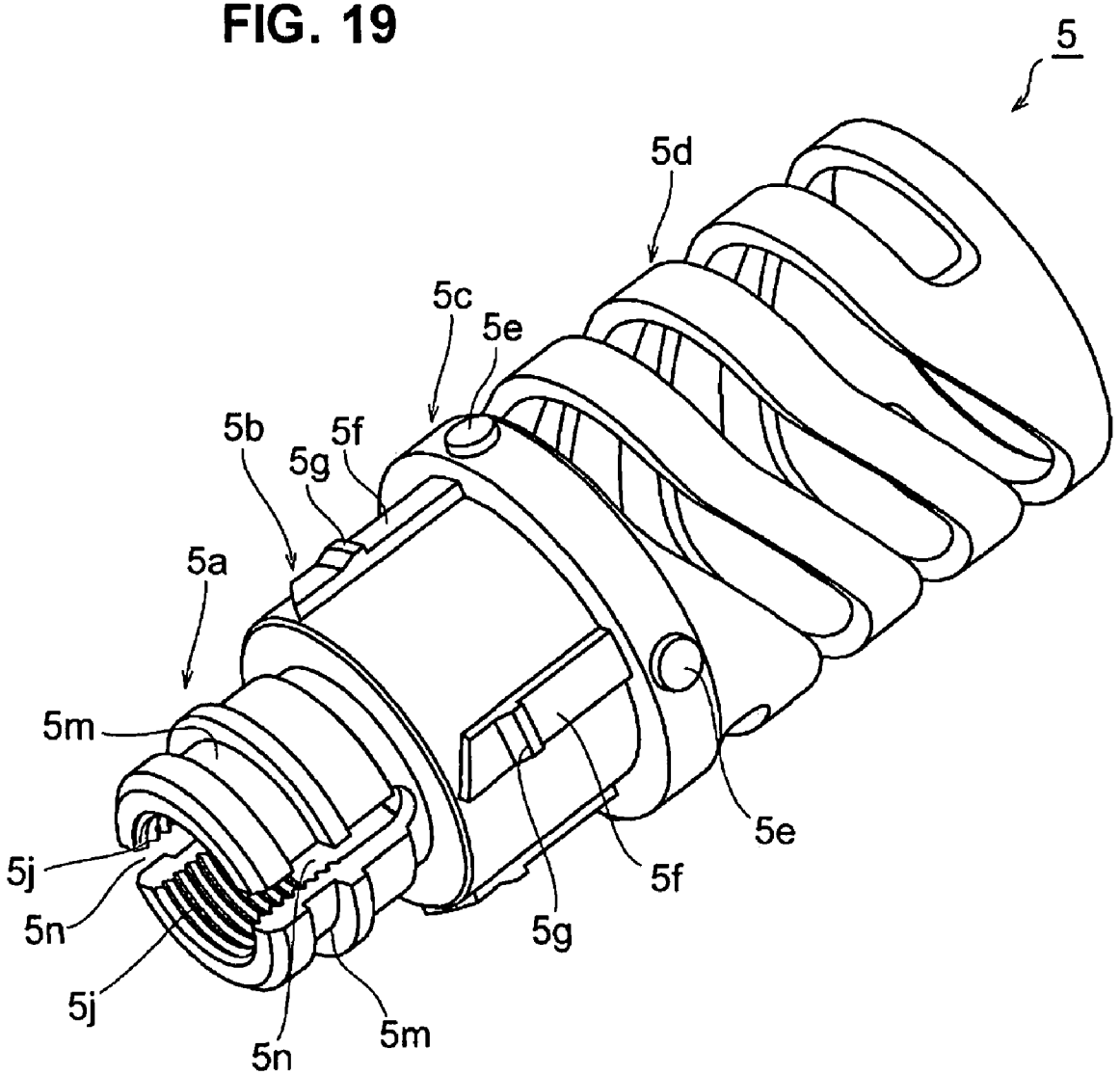
FIG. 19 is a perspective view showing a filling member movable body in FIGS. 1 to 5.
Figure 20:
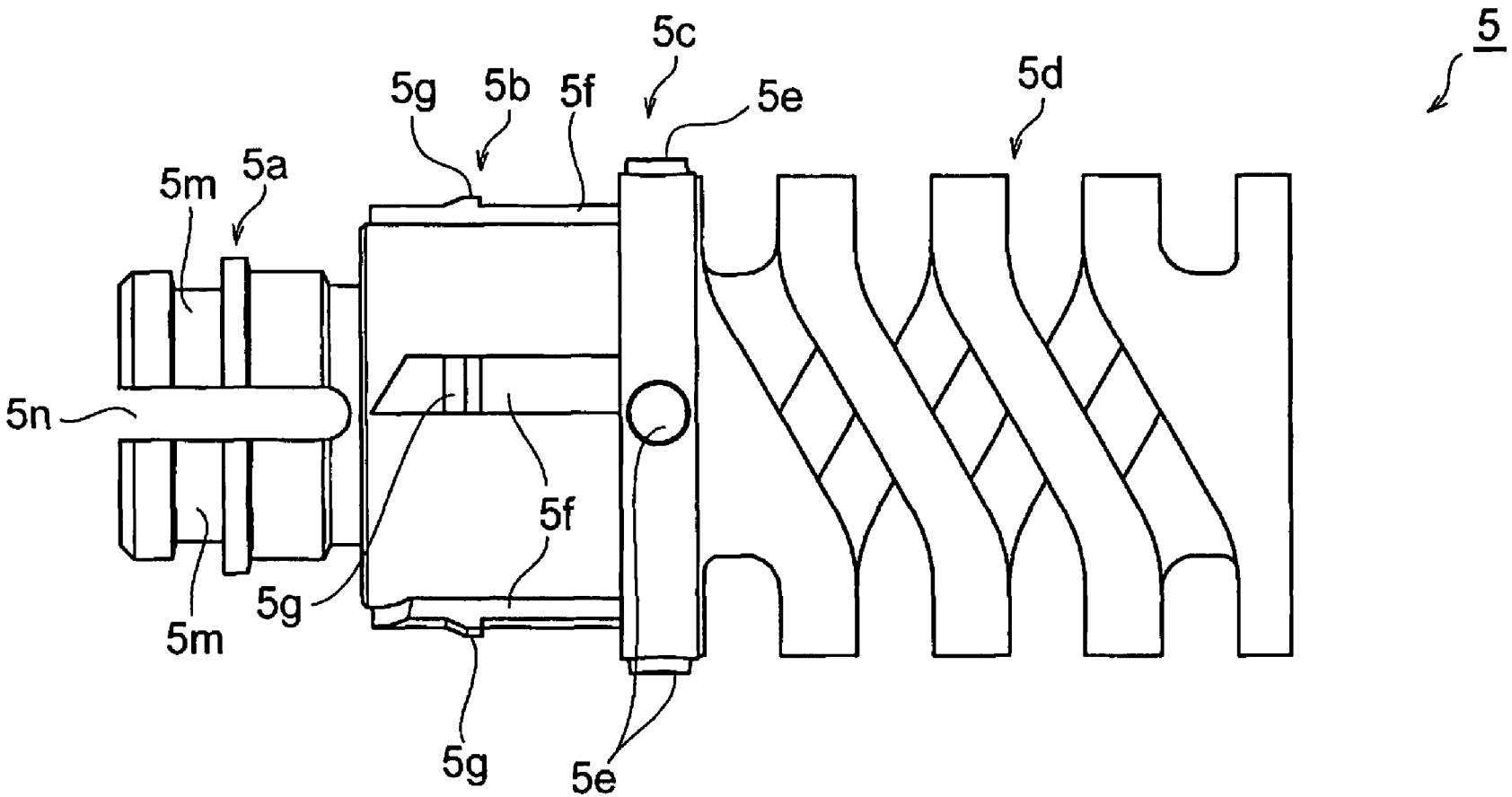
FIG. 20 is a side view showing the filling member movable body in FIGS. 1 to 5.
Figure 21:
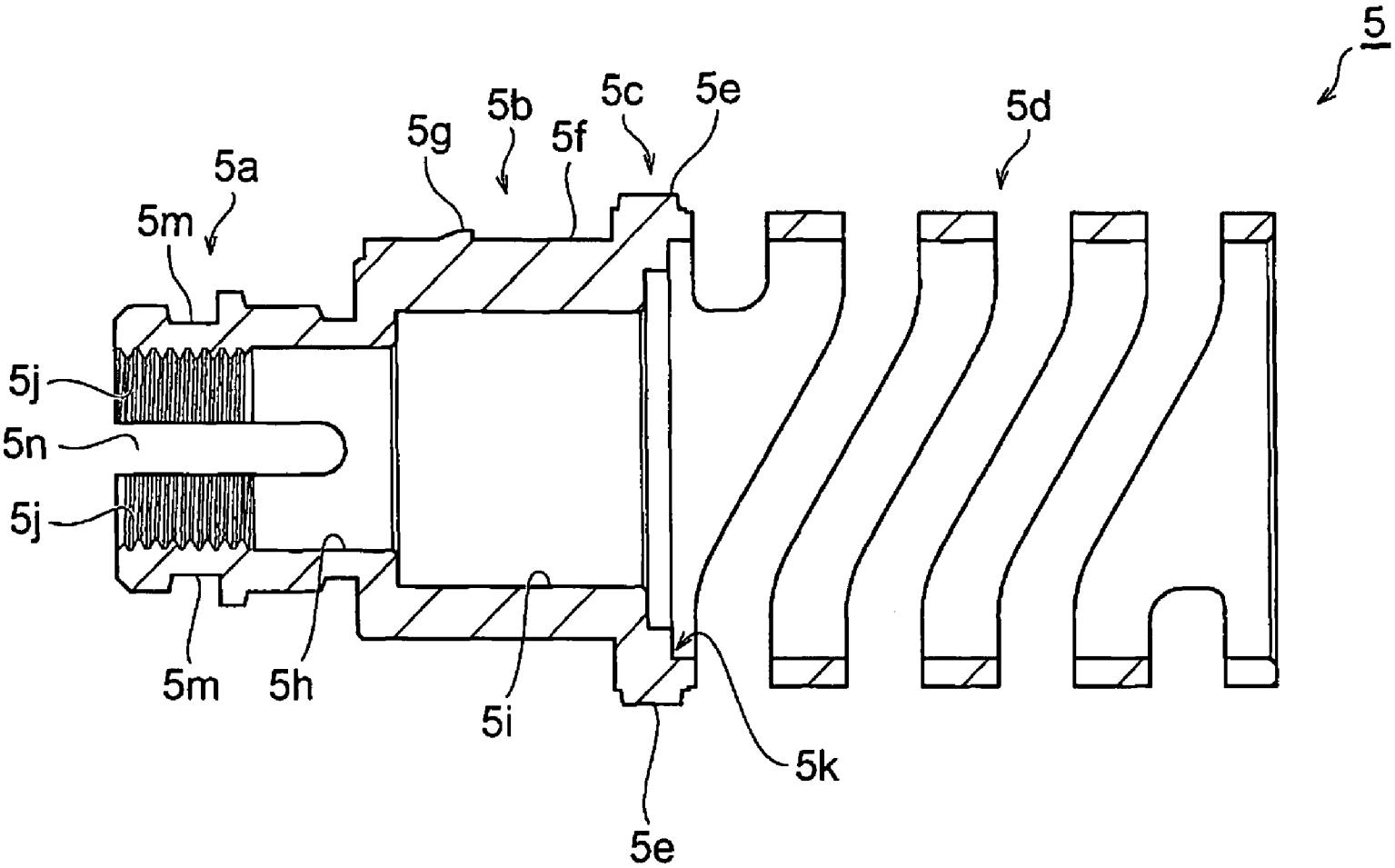
FIG. 21 is a longitudinal sectional view of the filling member movable body shown in FIG. 20.
Figure 22:
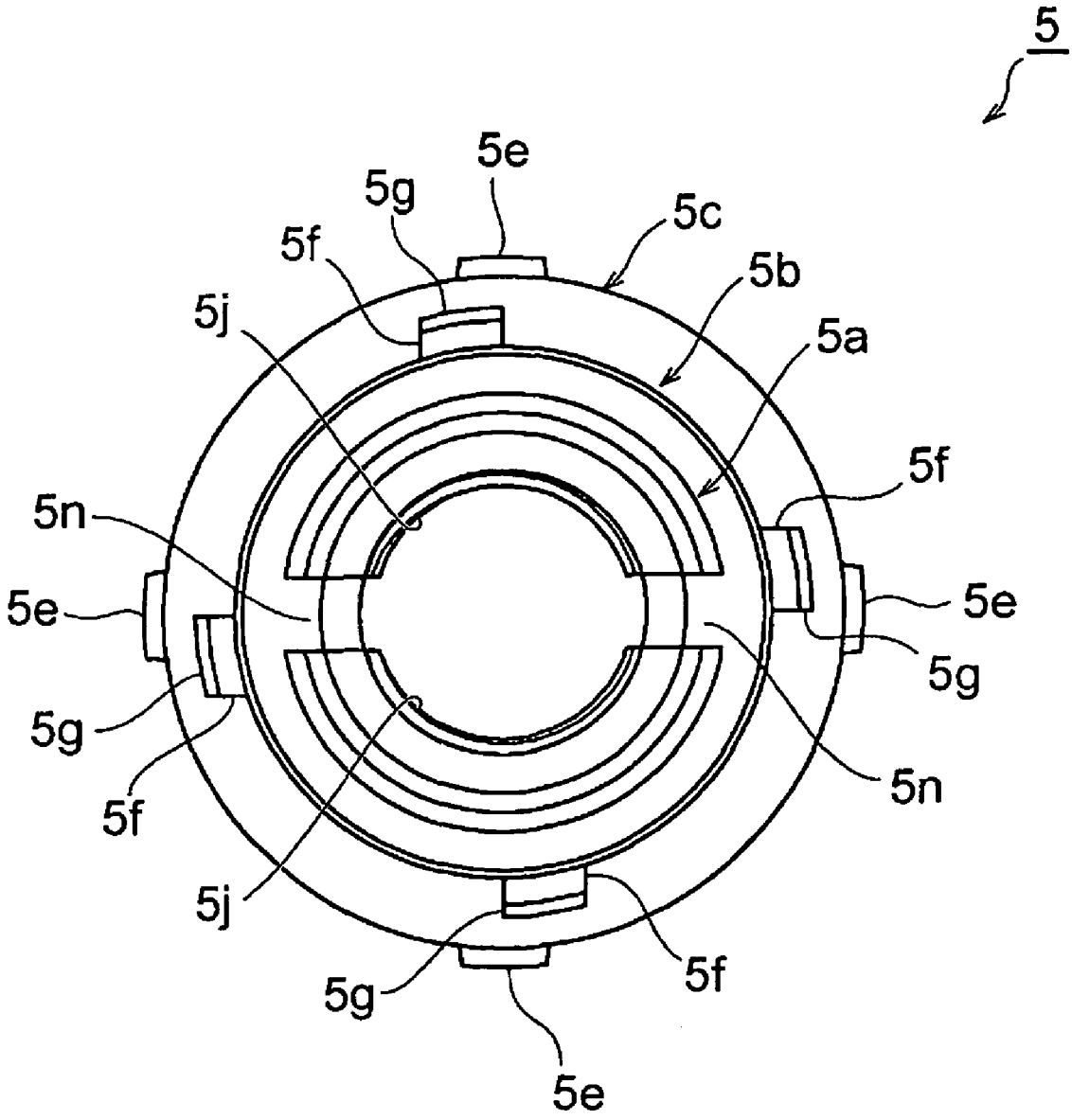
FIG. 22 is a left side view of the filling member movable body shown in FIG. 20.

The filling member movable body 5 is formed as an injection molded product by a resin by connecting a spring portion (a filling member side spring portion) 5*d* freely expanding and contracting in the axial direction to a rear end of a stepped cylinder portion provided with a leading end outer diameter small-diameter portion 5*a*, an outer diameter middle-diameter portion 5*b* continuously provided in a rear end of the outer diameter small-diameter portion 5*a* and an outer diameter large-diameter portion 5*c* continuously provided in a rear end of the outer diameter middle-diameter portion 5*b*, as shown in FIGS. 19 to 21. As shown in FIGS. 19 to 22, the filling member movable body 5 is provided with a meshing projection (a filling member side thread) 5*e* serving as a male thread constituting the other side of the first meshing portion (the meshing mechanism) 8 at four uniformly arranged positions along a peripheral direction on an outer peripheral surface of the outer diameter large-diameter portion 5*c*.

Protrusions 5*f* are formed at four uniformly arranged positions along a peripheral direction on an outer peripheral surface of the outer diameter middle-diameter portion 5*b*, in the filling member movable body 5 so as to extend at a predetermined length in an axial direction, and a protruding portion 5*g* is formed in a circular arc shape along a peripheral direction on the protrusion 5*f*. The protrusion 5*f* and the protruding portion 5*g* are provided for installing the filling member 4. As shown in FIGS. 19 and 20, a leading end portion of the protrusion 5*f* is structured as a slant portion slanting all in one direction in such a manner as to easily enter into a portion between protrusions 4*e* and 4*e* mentioned below of the filling member 4.

The filling member movable body 5 is provided with a pair of slits 5*n* extending close to the outer diameter middle-diameter portion 5*b* from the leading end of the outer diameter small-diameter portion 5*a* and communicating inner and outer sides in both sides across the axis.

As shown in FIG. 21, an inner peripheral surface in a front side from the spring portion 5*d* of the filling member movable body 5 is formed as a small-diameter inner peripheral surface 5*h* from a leading end of the outer diameter small-diameter portion 5*a* to a leading end side of the outer diameter middle-diameter portion 5*b*, and is formed as a large-diameter inner peripheral surface 5*i* from a rear end of the small-diameter inner peripheral surface 5*h* to a rear end of the outer diameter large-diameter portion 5*c*. Further, as shown in FIGS. 19 and 21, a female thread 5*j* constituting the other side of the second meshing portion (the meshing mechanism) 9 is provided in a front half portion of the small-diameter inner peripheral surface 5*h* of the filling member movable body 5 so as to come across the slits 5*n* and 5*n* and form a semicircular arc shape. Further, as shown in FIG. 21, a concave portion 5*k* having a larger diameter than the large-diameter inner peripheral surface 5*i* and depressed to the front side is provided in the rear end surface of the outer diameter large-diameter portion 5*c* of the filling member movable body 5. The concave portion 5*k* is utilized at a time of assembling as mentioned below.

The filling member movable body 5 is provided with a groove portion 5*m* for installing an O-ring (an elastic portion; a ring-shaped elastic body) 11 shown in FIG. 1 in an outer peripheral surface in a leading end side in the outer diameter small-diameter portion 5*a* corresponding to an outer peripheral side of the female thread 5*j* so as to come across the slits 5*n* and 5*n* and form a semicircular arc shape along a peripheral direction.

The filling member movable body 5 is fitted outside the piston movable body 6 and inserted inside the rear portion of the leading tube 3, as shown in FIG. 1, the leading end surface of the outer diameter small-diameter portion 5*a* is brought into contact with the rear end surface of the collar portion 6*a* of the piston movable body 6 in a state that the female thread 5*j* is meshed with the male thread 6*b* of the piston movable body 6, the spring portion 5*d* surrounds the cylinder portion 1*d* of the main body tube 1, the rear end surface of the spring portion 5*d* is brought into contact with the bottom portion of the main body tube 1, and the meshing projection 5*e* is set to the state of being pressed against the step surface 3*e* of the leading tube 3 by the spring portion 5*d* in a state that the meshing projection 5*e* is detached from the rear end of the spiral groove 3*b* of the leading tube 3 and the meshing is cancelled.

The O-ring 11 is installed to the groove portion 5*m* of the filling member movable body 5, and the outer diameter small-diameter portion 5*a* of the filling member movable body 5 divided by the slits 5*n* and 5*n* is fastened on the basis of an elastic force of the O-ring 11, whereby an actuation resistance of the second meshing portion 9 constituted by the female thread 5*j* of the filling member movable body 5 and the male thread 6*b* of the piston movable body 6 is increased and is set higher in comparison with an actuation resistance of the first meshing portion 8 constituted by the meshing projection 5*e* of the filling member movable body 5 and the spiral groove 3*b* of the leading tube 3 (FIG. 1 shows a meshing standby state in which the meshing is cancelled).

In this case, although the O-ring 11 is used, another ring-shaped elastic body, for example, a C-ring or the like may be used. Further, if the structure is made such that the inner diameter of the female thread 5*j* is expanded by the slits 5*n* and thus the meshing can be achieved by inserting the male thread 6*b* of the piston movable body 6 to the female thread 5*j* of the filling member movable body 5, the outer diameter small-diameter portion 5*a* having the female thread 5*j* and the slits 5*n* serves as an elastic portion applying an elastic force to the second meshing portion 9, whereby the ring-shaped elastic body may be omitted.

In the first meshing portion 8 (refer to FIG. 2) constituted by the meshing projection 5*e* of the filling member movable body 5 and the spiral groove 3*b* of the leading tube 3, and the second meshing portion 9 constituted by the female thread 5*j* of the filling member movable body 5 and the male thread 6*b* of the piston movable body 6, as shown in FIGS. 14 and 21, a lead of the first meshing portion 8 is made larger in comparison with a lead of the second meshing portion 9, the pressing mechanism provided with the rotation preventing portion 50 constituted by the first and second meshing portions 8 and 9, the protrusion 6*d* of the piston movable body 6 and the protrusion 1*c* of the shaft body 1*b* of the main body tube 1, the filling member movable body 5, the piston movable body 6 and the piston 7 are installed in the main body side tube body constituted by the main body tube 1, the leading tube pressing member 2 and the leading tube 3, whereby the main body side assembly 40 is structured (refer to FIG. 26).

The filling member 4 is provided for filing an applying filler L to an internal filling region 4*x*, as shown in FIG. 1, and is provided for discharging the applying filler L from a leading end portion in accordance with an operation of a user. A material of the filling member 4 is preferably constituted by an injection molded plastic such as a polyethylene terephthalate (PET), a polypropylene (PP) and the like, and it is preferable to use a transparent material so as to confirm a color tone and a filling state of the applying filler L and a colored material to which a color of the applying filler L is applied.

The filling member 4 is formed in a cylindrical shape and is formed such that a leading end is tapered and closed, as shown in FIGS. 24 and 25, and an outer surface 4*a* of the leading end portion is formed as an inclined surface inclined in a predetermined direction. Further, an inner surface 4*b* is formed as an inclined surface apart from the outer surface 4*a* by a fixed thickness in a back surface of the outer surface 4*a* in the leading end portion of the filling member 4, and a discharge port 4*c* communicating the inner surface 4*b* and the outer surface 4*a* is provided. Further, the inclined outer surface 4*a* serves as an applying portion for applying the applying filler L discharged through the discharge port 4*c* to an applied portion. The applying portion 4*a* is formed as an inclined surface suitable for applying to the applied portion, for example, a skin or the like. In this case, the number of the discharge ports 4*c* may be in a plural number.

The rear portion of the filling member 4 is provided with an annular slit 4*d* communicating inner and outer sides, and an inner peripheral surface of the rear portion is provided with a plurality of protrusions 4*e* extending at a predetermined length in an axial direction from a portion near the rear end of the filling member 4 and crossing the slit 4*d* at a uniform interval along the peripheral direction. Accordingly, the slit 4*d* is structured such that a portion which the protrusion 4*e* crosses is formed as a groove 4*f*, and a portion between the protrusions 4*e* and 4*e* is formed as an opening 4*g*. The opening 4*g* is provided for engaging with the protrusion 5*g* of the filling member movable body 5 in the axial direction, and the protrusion 4*e* is provided for engaging with the protrusion 5*f* of the filling member movable body 5 in the rotational direction. The rear end portion of the protrusion 4*e* is structured as a slant portion all slanting in one direction, in such a manner that the protrusion 5*f* of the filling member movable body 5 easily enter into the portion between the protrusions 4*e* and 4*e*. Further, the filling member 4 is provided with an outer peripheral step surface 4*h* for fitting an assembling jig mentioned below on an outer peripheral surface in a leading end side from the leading end side and stay it there.

The filling member 4 is inserted inside the leading tube 3 as shown in FIG. 1, a rear portion thereof is fitted outside the filling member movable body 5, the protrusion 5*f* of the filling member movable body 5 moves forward to and is engaged with the portion between the protrusions 4*e* and 4*e*, and the protrusion 5*g* of the filling member movable body 5 moves forward to and is engaged with the opening 4*g*, whereby the filling member 4 is installed to the filling member movable body 5 so as to be non-rotatable and be immobile in the axial direction, is integrally formed with the filling member movable body 5, and is accommodated within the leading tube 3 in this state. Further, the cap 10 is detachably engaged with the protruding portion 2*e* of the leading tube pressing member 2, whereby the leading tube 3 accommodating the filling member 4 is covered and protected.

In the case of assembling the applying filler extruding container 100 having the structure mentioned above, the main body side assembly 40 shown in FIG. 26 is obtained by first screwing the filling member movable body 5 into the piston movable body 6, next installing the O-ring 11 to the filling member movable body 5, next installing the piston 7 to the piston movable body 6, next screwing the filing member movable body 5 to the leading tube 3, next fitting the leading tube pressing member 2 outside the leading tube 3, and next inserting the leading tube pressing member 2 inside the main body tube 1 in such a manner that the piston movable body 6 is engaged with the shaft body 1*b* of the main body tube 1.

In the main body side assembly 40 shown in FIG. 26, in order to correspond to the assembly shown in FIG. 28 mentioned below, the meshing projection 5*e* of the filling member movable body 5 is positioned at a leading end 3*f* of the spiral groove 3*b* of the leading tube 3, and the filling member movable body 5 is positioned at the forward limit, however, in the case of corresponding to the assembly shown in FIG. 27 mentioned below, the meshing projection 5*e* of the filling member movable body 5 is detached from the rear end of the spiral groove 3*b* of the leading tube 3 so as to cancel the meshing, and is set to a state of being pressed to the step surface 3*e* of the leading tube 3 by the spring portion 5*d*.

On the other hand, as shown in FIG. 26, in a state that the discharge port 4*c* is closed by a seal 12 and the filling member 4 is reversed, a predetermined amount of applying filler L is filled in the filing region 4*x* until there is no space within the leading end of the filling member 4. Further, the filling member 4 filled with the applying filler L is inserted in the leading end side of the main body side assembly 40 so as to be installed to the filling member movable body 5.

In the case that the meshing projection 5*e* of the filling member movable body 5 is detached from the rear end of the spiral groove 3*b* of the leading tube 3 so as to cancel the meshing, and is pressed to the step surface 3*e* of the leading tube 3 by the spring portion 5*d*, a cylindrical rising portion 13*a* of a lower jig 13 is inserted inside the leading tube 3 and is fitted outside the filling member 4, as shown in FIG. 27, an upper end surface of the cylindrical rising portion 13*a* is brought into contact with the outer peripheral step surface 4*h* of the filling member 4, a lower end surface of an upper jig 14 is brought into contact with the rear end surface of the main body tube 1, and the upper jig 14 is descended in a predetermined manner or the lower jig 13 is ascended in a predetermined manner. Accordingly, the cylinder portion 1*d* of the main body tube 1 enters into the concave portion 5*k* of the outer diameter large-diameter portion 5*c* of the filling member movable body 5 and is set to a state of being positioned in a radial direction and brought into contact therewith, the protrusion 5*f* of the filler member movable body 5 enters into the portion between the protrusions 4*e* and 4*e* of the filling member 4 so as to be engaged in the rotational direction, the protruding portion 5*g* of the filling member movable body 5 enters into the opening 4*g* of the filling member 4 so as to be engaged in an axial direction, and the filling member movable body 5 and the filling member 4 are integrally coupled. At this time, the filing member 4 is engaged with the filing member movable body 5 while the inner peripheral surface thereof is brought into slidable contact with the annular protruding portion 7*c* for securing a water tightness of the piston 7.

Next, when the jigs 13 and 14 are detached, a front side portion from the spring portion 5*d* of the filling member movable body 5, the piston movable body 6 coupled to the filling member movable body 5 and the filling member 4 move forward all together at a deflection amount of the spring portion 5*d* on the basis of the energizing force of the spring portion 5*d* of the filling member movable body 5, the meshing projection 5*e* of the filling member movable body 5 is set to a state of being pressed to the step surface 3*e* of the leading tube 3 by the spring portion 5*d*, and the applying filler extruding container 100 in an initial state shown in FIG. 1 is obtained by finally peeling the seal 12 off. In the applying filler extruding container 100 in the initial state, the filling member 4 is accommodated within the leading tube 3, and the rear end surface of the piston movable body 6 stays near the bottom portion of the main body tube 1.

In the case that the filling member 4 reaches the forward limit, as shown in FIG. 28, a cylindrical rising portion 15*a* of a lower jig 15 is fitted outside the filling member 4, an upper end surface of the cylindrical rising portion 15*a* is brought into contact with the outer peripheral step surface 4*h* of the filling member 4, a plurality of protruding portions 16*a* extending to a lower side of an upper jig 16 are brought into contact with the rear end surface of the filling member movable body 5 while being respectively passed through the opening 1*e* of the main body tube 1, and the upper jig 16 is descended in a predetermined manner or the lower jig 15 is ascended in a predetermined manner. Accordingly, in the same manner as described in FIG. 27, the filling member movable body 5 and the filling member 4 are integrally coupled. The filling member movable body 5, the piston movable body 6 coupled to the filling member movable body 5 and the filling member 4 move backward all together by relatively rotating the main body tube 1 and the leading tube 3 in a feed-back direction (an opposite direction to one direction corresponding to the feeding direction) after detaching the jigs 15 and 16, details of which will be mentioned below. When the rear end surface of the filling member movable body 5 is brought into contact with the bottom portion of the main body tube 1, the meshing projection 5*e* of the filling member movable body 5 is detached from the rear end of the spiral groove 3*b* of the leading tube 3 so as to cancel the meshing, and the applying filler extruding container in the initial state can be obtained by finally peeling the seal 12 off.

In accordance with the applying filler extruding container 100 structured as mentioned above, as shown in FIG. 26, since the structure is made such that the filling member 4 filled with the applying filler L is inserted to the leading end side of the main body side assembly 40 so as to be installed, it is easy to assemble after filling the applying filler L in the filling member 4, and the applying filler L sufficiently (fully) fills up the filling region 4*x* between the inner side of the leading end of the filling member 4 and the piston 7 of the main body side assembly 40.

Further, the applying filler extruding container is sold as the applying filler extruding container 100 in the initial state as shown in FIG. 1 to a user, and when the cap 10 is detached and the main body tube 1 and the leading tube 3 are relatively rotated in the feeding direction (one direction) by the user, the actuation resistance of the second meshing portion 9 is high and the leading tube 3 and the filling member movable body 5 are relatively rotated, so that the meshing projection 5*e* of the filling member movable body 5, which is detached from the rear end of the spiral groove 3*b* of the leading tube 3 so as to cancel the meshing and is pressed to the step surface 3*e* of the leading tube 3 by the spring portion 5*d*, is meshed with the spiral groove 3*b* of the leading tube 3 and the meshing operation of the first meshing portion 8 is actuated.

Figure 2:
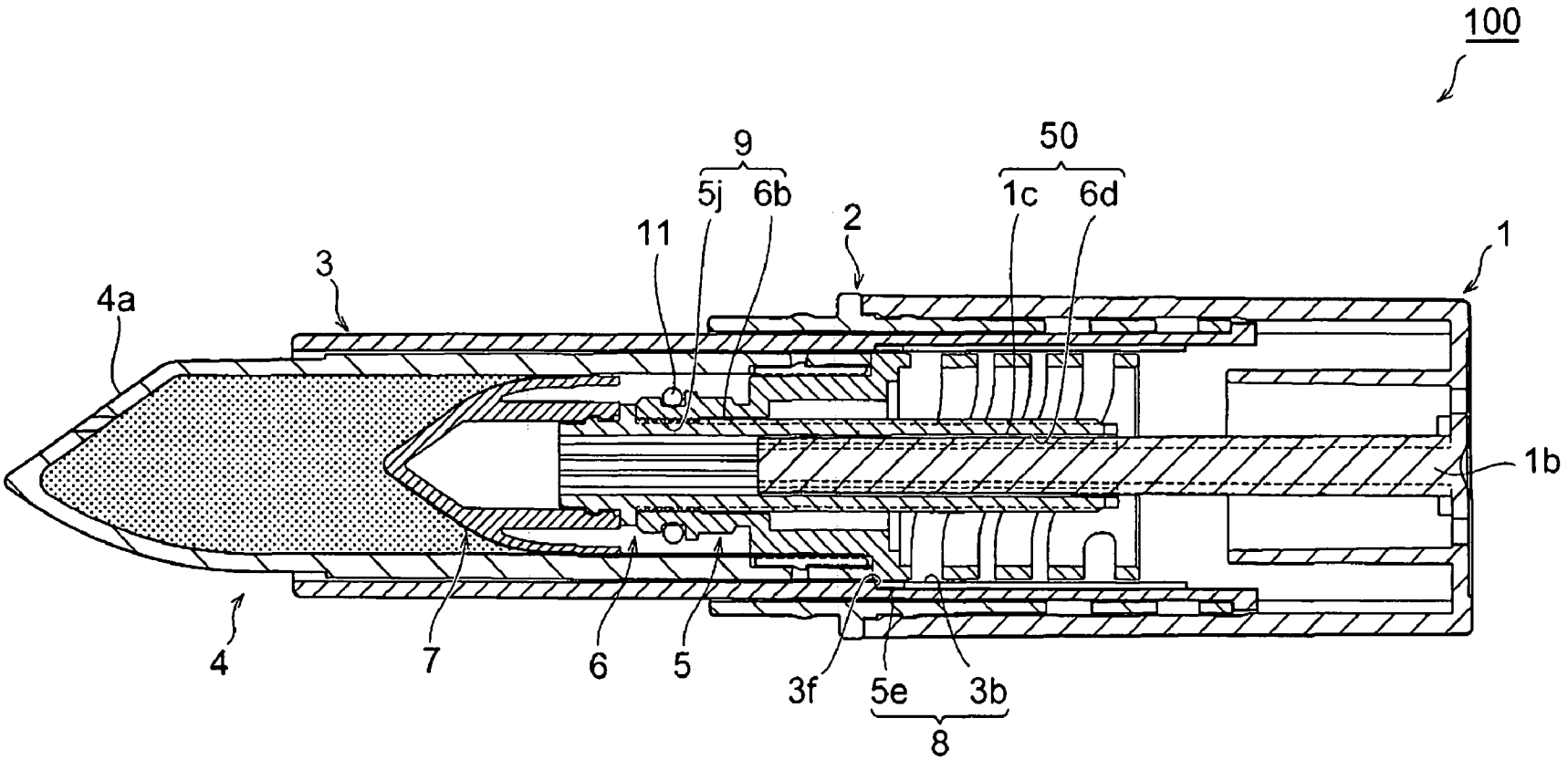
FIG. 2 is a longitudinal sectional view showing the applying filler extruding container in accordance with the first embodiment of the present invention, in a state that a filling member moves forward to the maximum on the basis of an operation of a user.

When the relative rotation in the feeding direction is continued, since the actuation resistance of the second meshing portion 9 is set higher in comparison with the actuation resistance of the first meshing portion 8 as mentioned above, the meshing operation of the first meshing portion 8 works first, the piston movable body 6 and the piston 7 move forward together with the filling member movable body 5 and the filling member 4 on the basis of the cooperation with the rotation preventing portion 50 constituted by the protrusion 1*c* of the shaft body 1*b* of the main body tube 1 and the protrusion 6*d* of the piston movable body 6, the filling member 4 and the applying portion 4*a* thereof appears from the opening in the leading end of the leading tube 3, and the filling member 4 moves forward to the forward limit where the meshing projection 5*e* of the filling member movable body 5 is positioned in the leading end 3*f* of the spiral groove 3*b* of the leading tube 3, as shown in FIG. 2.

At this time, since the lead of the first meshing portion 8 is made larger in comparison with the lead of the second meshing portion 9, the filling member 4 quickly reaches the use position corresponding to the forward limit in accordance with the large lead of the first meshing portion 8. When the meshing projection 5*e* of the filling member movable body 5 reaches the leading end 3*f* of the spiral groove 3*b* of the leading tube 3, the forward movement is inhibited, and the meshing operation of the first meshing portion 8 is stopped.

Figure 3:
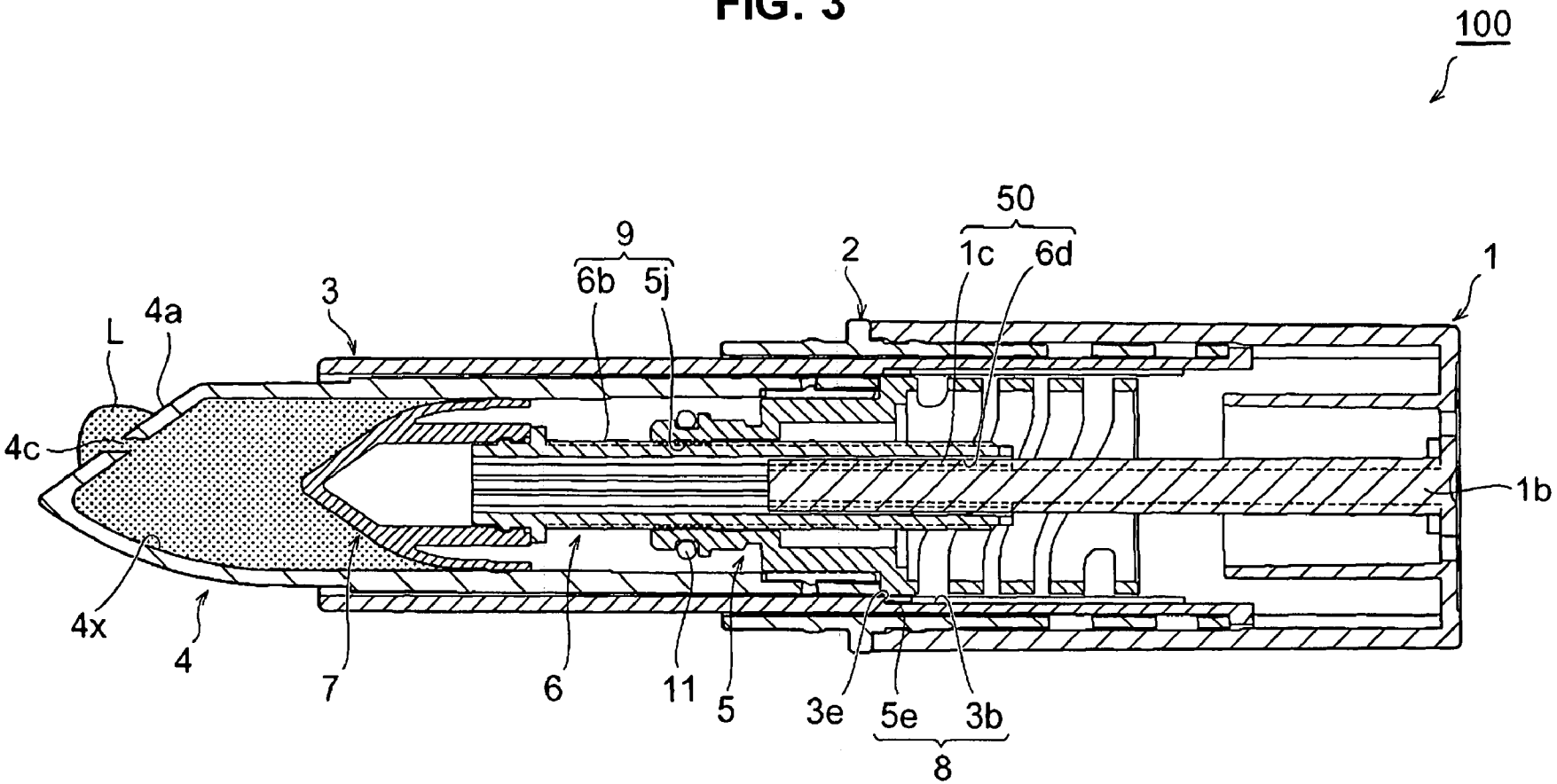
FIG. 3 is a longitudinal sectional view showing the applying filler extruding container in accordance with the first embodiment of the present invention, in a state that the filling member moves forward to the maximum on the basis of the operation of the user and a piston subsequently moves forward so as to be set in a use state.

When the main body tube 1 and the leading tube 3 are continuously rotated relatively in the feeding direction, since the meshing operation of the first meshing portion 8 is stopped, the meshing operation of the second meshing portion 9 works, and the piston movable body 6 and the piston 7 move forward as shown in FIG. 3 on the basis of the cooperation with the rotation preventing portion 50.

At this time, since the lead of the second meshing portion 9 is made smaller in comparison with the lead of the first meshing portion 8, the piston 7 is slowly fed out in accordance with the small lead of the second meshing portion 9, and the applying filler L is properly discharged from the discharge port 4*c* of the filling member 4 so as to be set to the use state.

As mentioned above, since the applying filler L is sufficiently filled in the filling region 4*x* between the inner side of the leading end of the filling member 4 and the piston 7, the applying filler L is discharged rapidly (immediately) from the discharge port 4*c* as shown in FIG. 3, without repeating the relative rotation more than necessary.

Figure 4:
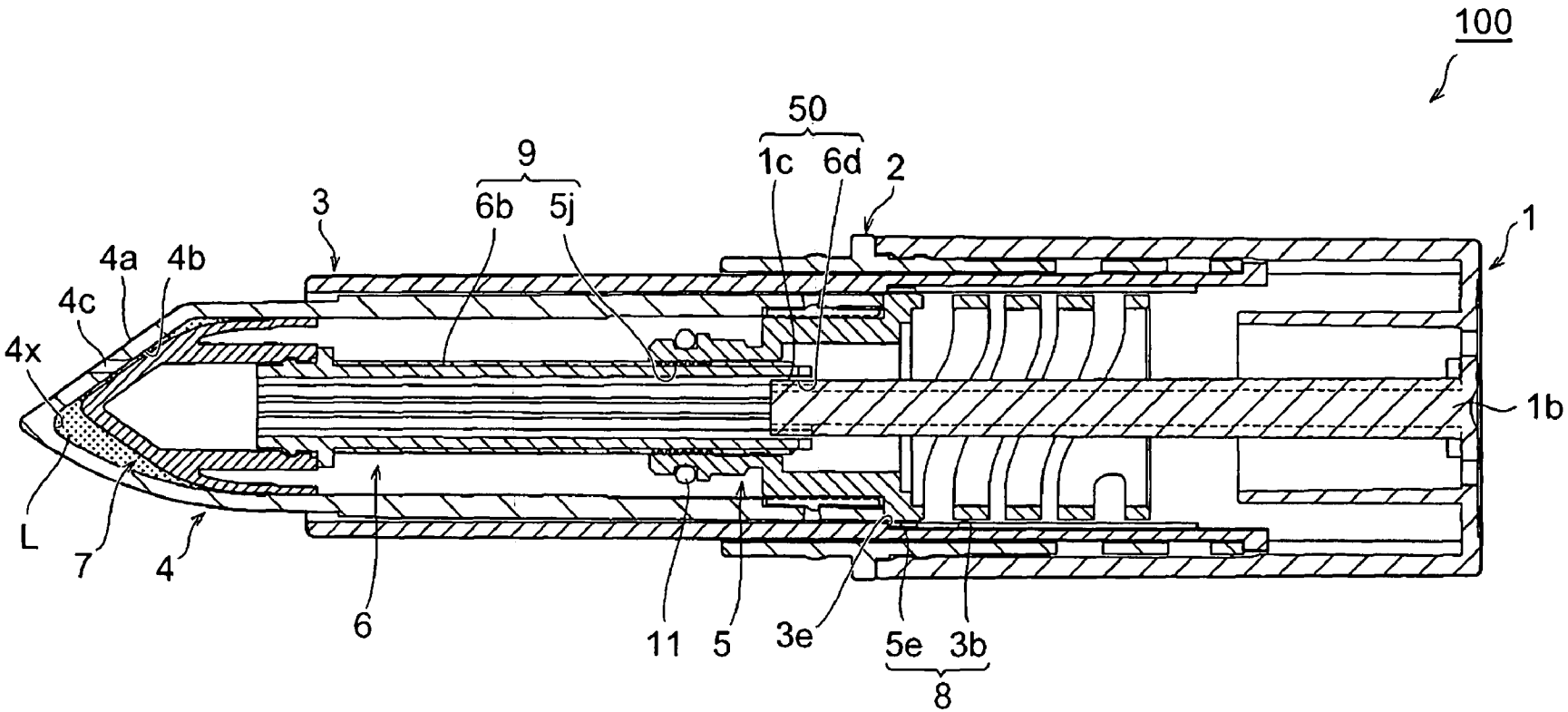
FIG. 4 is a longitudinal sectional view showing the applying filler extruding container in accordance with the first embodiment of the present invention, in a state that the filling member moves forward to the maximum on the basis of the operation of the user and the piston subsequently moves forward to the maximum.

When the piston 7 moves forward to the maximum so as to be brought into contact with the inner surface 4*b* of the leading end portion of the filling member 4, as shown in FIG. 4, on the basis of the relative rotation in the feeding direction between the main body tube 1 and the leading tube 3, the applying filler L in the filling region 4*x* is almost used up.

When the main body tube 1 and the leading tube 3 are relatively rotated in the feed-back direction (the opposite direction to the feeding direction) in a state that the piston 7 does not reach the forward limit as shown in FIG. 3, or in a state that the piston 7 reaches the forward limit as shown in FIG. 4, after being used, since the second actuation resistance is set higher in comparison with the actuation resistance of the first meshing portion 8 as mentioned above, the meshing operation of the first meshing portion 8 works first, the piston movable body 6 and the piston 7 move backward together with the filling member movable body and the filling member 4 on the basis of the cooperation with the rotation preventing portion 50, and the filling member 4 and the applying portion 4*a* thereof are retracted from the opening in the leading end of the leading tube 3.

Figure 5:
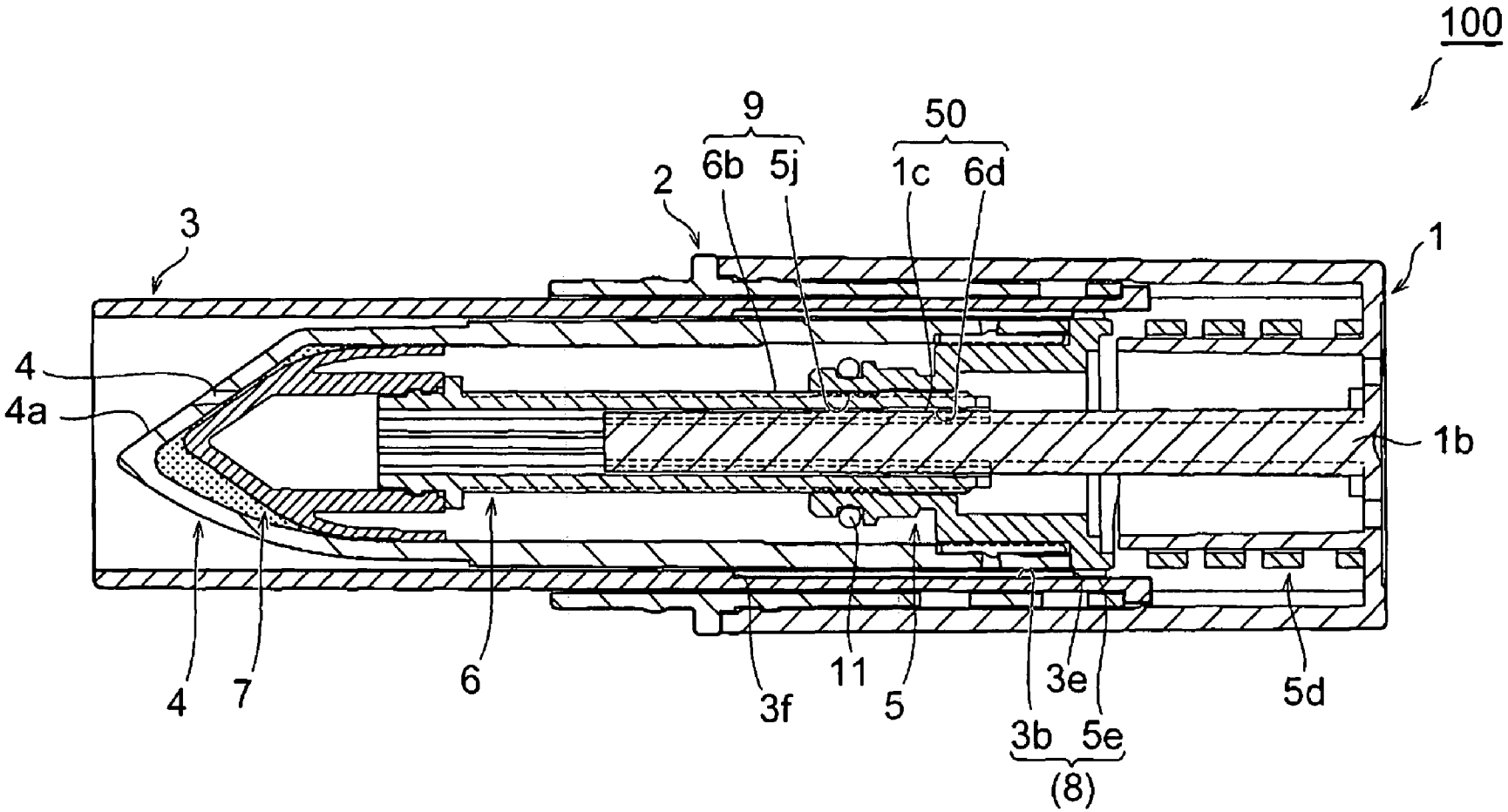
FIG. 5 is a longitudinal sectional view showing the applying filler extruding container in accordance with the first embodiment of the present invention, in a state that the filling member moves backward to the maximum on the basis of the operation of the user.
Figure 6:
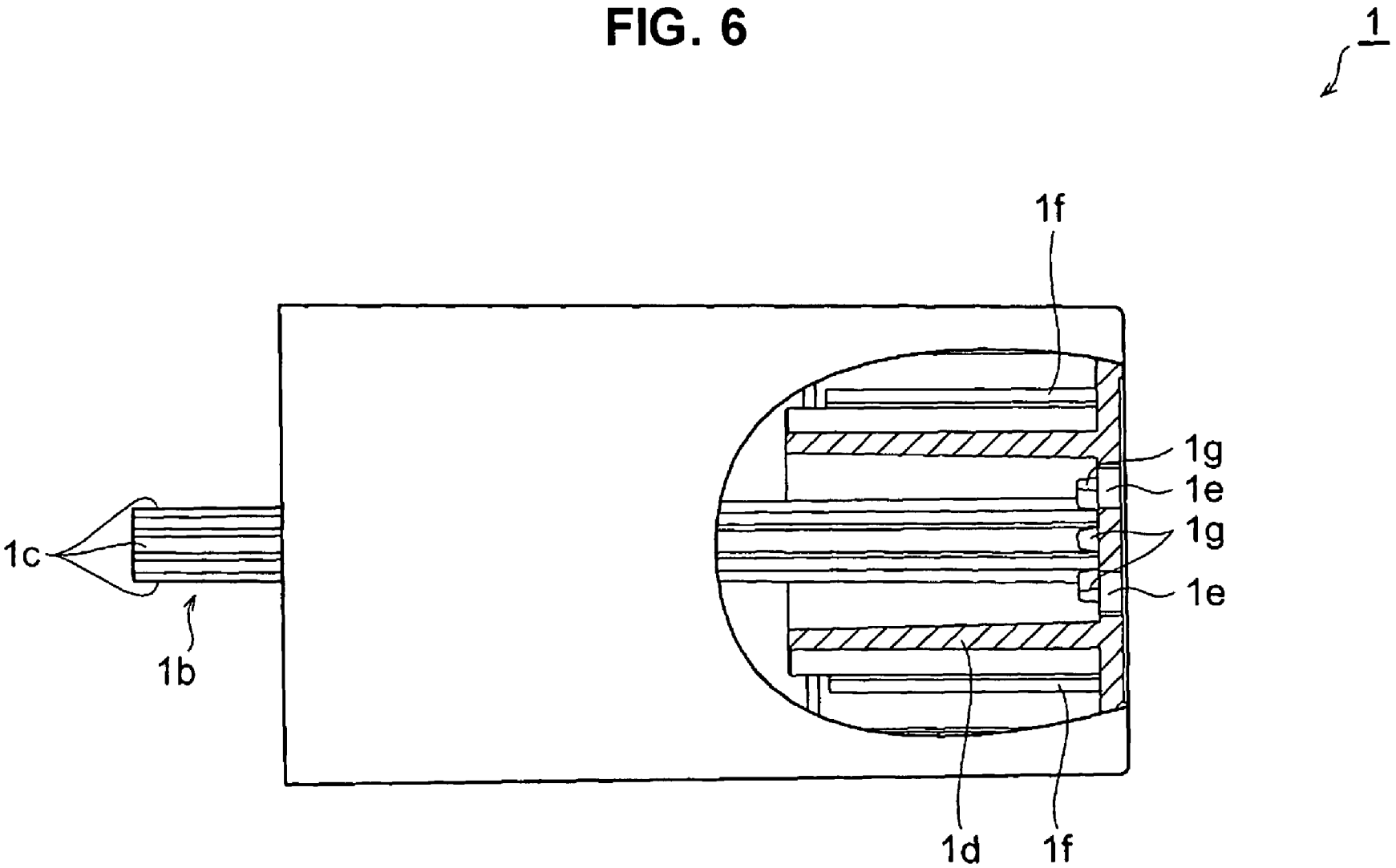
FIG. 6 is a partly sectional side view showing a main body tube in FIGS. 1 to 5.

At this time, since the lead of the first meshing portion 8 is made larger in comparison with the lead of the second meshing portion 9, the filling member 4 is quickly fed back in accordance with the large lead of the first meshing portion 8. When the applying portion 4*a* is fed back to the accommodating position within the leading tube 3, the rear end surface of the filling member movable body 5 is brought into contact with the bottom portion of the main body tube 1 as shown in FIG. 5, and the meshing projection 5*e* of the filling member movable body 5 is detached from the rear end of the spiral groove 3*b* of the leading tube 3 so as to cancel the meshing, and is set to the state of being pressed to the step surface 3*e* of the leading tube 3 by the spring member 5*d*.

Accordingly, even if the main body tube 1 and the leading tube 3 are relatively rotated further in the feed-back direction in this state, the main body tube 1 and the leading tube 3 idly run, the meshing operation of the second meshing portion 9 does not work, the piston 7 does not move backward, and the applying filler L is in a state of moving forward near the discharge port 4*c* (refer to FIG. 1). The applying filler extruding container 100 shown in FIG. 5 is in a state that the filling member 4 including the piston 7 reaching the forward limit is fed back.

In the case that the filling member 4 is fed back in the state that the piston 7 does not reach the forward limit as shown in FIG. 3 and the applying filler L is left in the filling region 4*x*, the main body tube 1 and the leading tube 3 are again relatively rotated in the feeding direction by a user so as to set the applying filler L to the use state. Accordingly, the meshing projection 5*e* of the filling member movable body 5, which is detached from the rear end of the spiral groove 3*b* of the leading tube 3 so as to cancel the meshing and is pressed to the step surface 3*e* of the leading tube 3 by the spring portion 5*d*, is returned to be meshed with the spiral groove 3*b* of the leading tube 3, and the meshing operation of the first meshing portion 8 works again.

When the relative rotation in the feeding direction is continued, the filling member 4 including the piston 7 moves forward on the basis of the first worked meshing operation of the first meshing portion 8, the applying portion 4*a* appears from the leading tube 3 and the filling member 4 reaches the forward limit as mentioned above. When the relative rotation in the feeding direction is continued, the piston 7 moves forward on the basis of the meshing operation of the second meshing portion 9, and since the applying filler L is in a state of moving forward near the discharge port 4*c* as mentioned above at this time, the applying filler L is immediately set to the use state by the piston 7. The same operation as mentioned above is executed after being used, and the operations mentioned above are repeated.

As mentioned above, in accordance with the applying filler extruding container 100 of the present invention, when the main body tube 1 and the leading tube 3 are relatively rotated in the feeding direction (one direction), meshing operation works by the first meshing portion and thereby the filling member 4 moves forward so as to appear from the leading tube 3 and be fed to the use position. When it is relatively rotated in the feeding direction further, meshing operation works by the second meshing portion instead of the first meshing portion and thereby the applying filler L is discharged from the discharge port 4*c* of the filling member 4 so as to be set to the use state. When the main body tube 1 and the leading tube 3 are relatively rotated in the feed-back direction (the opposite direction to the one direction), meshing operation works by the first meshing portion and thereby the filling member 4 moves backward and is accommodated within the leading tube 3 so as to be returned to the accommodated position. In particular, when the main body tube 1 and the leading tube 3 are relatively rotated in the feeding direction, the meshing operation of the first meshing portion 8 works first, the filling member 4 including the piston movable body 6 (the piston 7) moves forward so that the applying portion 4*a* appears from the leading tube 3. When the filling member 4 is fed out to the use position corresponding to the forward limit, the meshing operation of the first meshing portion 8 is stopped. When the main body tube 1 and the leading tube 3 are relatively rotated further in the feeding direction in a state that the meshing operation is stopped, the meshing operation of the second meshing portion 9 works at this time, the piston movable body 6 (the piston 7) moves forward, and the applying filler L is set to the use state. When the main body tube 1 and the leading tube 3 are relatively rotated in the feed-back direction after being used, the meshing operation of the first meshing portion 8 works first, the filling member 4 including the piston movable body 6 (the piston 7) moves backward and the applying portion 4*a* is retracted into the leading tube 3 so as to be fed back to the accommodated position. As mentioned above, since the filling member 4 is structured such as to appear from and be retracted into the leading tube 3, improvement in view of sanitation and protection of the applying filler L by the leading tube 3 can be achieved, an entire length is made short and compact after being used, a proper entire length is achieved at a time of being used, and a handling characteristic and a using characteristic (a usability) are improved. In addition, it is possible to use in the same feeling as that of a container for a rod-shape cosmetic material, for example, a lip stick or the like, and the using feeling is improved.

Further, when the main body tube 1 and the leading tube 3 are relatively rotated in the feed-back direction after the filling member 4 reaches the forward limit, the applying portion 4*a* appears from the leading tube 3 and the applying filler L is discharged from the discharge port 4*c* on the basis of the forward movement of the piston movable body 6 (the piston 7) so as to be set to the used state, the filling member 4 including the piston movable body 6 (the piston 7) moves backward on the basis of the first worked meshing operation of the meshing portion 8. When the applying portion 4*a* reaches the predetermined position to be accommodated within the leading tube 3, the meshing of the first meshing portion 8 is cancelled and the main body tube 1 and the leading tube 3 runs idly so that the meshing operation of the second meshing portion 9 does not work. Then, the applying filler L is set to the state of moving forward near the discharge port 4*c* as the piston movable body 6 (the piston 7) does not move backward on the basis of the idle running. When the main body tube 1 and the leading tube 3 are relatively rotated in the feeding direction, the first meshing portion 8 is returned to be meshed, and the filling member 4 including the piston movable body 6 (the piston 7) moves forward. Therefore, when the filling member 4 reaches the forward limit and the piston movable body 6 (the piston 7) moves forward on the basis of the further relative rotation in the feeding direction of the main body tube 1 and the leading tube 3, the applying filler L in the state of moving forward near the discharge port 4*c* is immediately set to the use state, and thus the using characteristic (the usability) is improved.

In this case, as another structure for returning the first meshing portion 8 to be meshed, there can be shown a structure in which a spring energizing the filling member movable body 5 to a front side is provided in the bottom portion of the main body tube 1 instead of the spring portion 5*d* of the filling member movable body 5. Further, it is possible to employ a structure in which the spring portion 5*d* of the filling member movable body 5 is replaced by a cylinder portion having no spring characteristic, and the meshing projection 5*e* of the filing member movable body 5 is received in the spiral groove 3*b* of the leading tube 3 at a time when the rear end surface of the cylinder portion of the filling member movable body 5 is brought into contact with the bottom portion of the main body tube 1 and the filling member 4 reaches the backward limit in the initial state of the applying filler extruding container 100 as shown in FIG. 1. In accordance with the structure, when the main body tube 1 and the leading tube 3 are further relatively rotated in the feed-back direction in a state that the rear end surface of the cylinder portion of the filling member movable body 5 is brought into contact with the bottom portion of the main body tube 1 and the filling member 4 reaches the backward limit, the leading tube 3 moves to the front side against the energizing force of the spring portion 2*d* of the leading tube pressing member 2, whereby the meshing projection 5*e* of the filling member movable body 5 comes off from the rear end of the spiral groove 3*b* of the leading tube 3 and the meshing is cancelled. Under this state, the collar portion 3*a* of the leading tube 3 is energized to the rear side by the spring portion 2*d* of the leading tube pressing member 2, and the meshing projection 5*e* of the filling member movable body 5 is pressed to the step surface 3*e* of the leading tube 3 in the same manner as the spring portion 5*d* of the filling member movable body 5 mentioned above. Accordingly, when the main body tube 1 and the leading tube 3 are relatively rotated in the feeding direction, the meshing of the first meshing portion 8 can be returned.

Further, in accordance with the applying filler extruding container 100 of the present embodiment, since the container is provided with the leading tube pressing member 2 including the spring portion 2*d* which is accommodated within the main body tube 1 and freely expands and contracts in the axial direction, and the leading tube 3 is rotatably installed to the main body tube 1 via the leading tube pressing member 2 in the state of being energized to the rear side by the spring portion 2*d* of the leading tube pressing member 2, a rotational resistance with a good feeling is applied by the spring portion 2*d* of the leading tube pressing member 2 at a time when the main body tube 1 and the leading tube 3 are relatively rotated, it is possible to buffer external force such as impact, vibration or the like applied, for example, due to drop of the container 100 or the like, it is possible to prevent the applying filler L from leaking out from the discharge port 4*c*, and it is possible to prevent the member from being broken.

Further, since the lead of the first meshing portion 8 is made larger in comparison with the lead of the second meshing portion 9, the filling member 4, to which the meshing operation of the first meshing portion 8 works, is quickly fed out to the use position in accordance with the large lead on the basis of the relative rotation in the feeding direction of the main body tube 1 and the leading tube 3, the applying portion 4*c* appears from the inner side of the leading tube 3, the piston movable body 6 (the piston 7), to which the meshing operation of the second meshing portion 8 works, is slowly fed out in accordance with the small lead on the basis of the further relative rotation in the feeding direction of the main body tube 1 and the leading tube 3, and the applying filler L is discharged from the discharge port 4*c* of the filling member 4 properly so as to be set to the use state. After being used, the filling member 4 is quickly fed back in accordance with the large lead on the basis of the relative rotation in the feed-back direction of the main body tube 1 and the leading tube 3, and the applying portion 4*a* is retracted into the leading tube 3 so as to be moved back to the accommodated position. Therefore, the using characteristic (the usability) is further improved.

In accordance with the present embodiment, the structure is made such that the actuation resistance of the second meshing portion 9 is increased by utilizing the elastic force of the elastic portion, however, as other structures for increasing the actuation resistance, for example, there can be shown a structure in which a material is differentiated, a structure in which the contact resistance of the thread is differentiated, or the like.

Further, as further another structure for increasing the actuation resistance of the second meshing portion 9, for example, there can be shown a structure on the basis of a sliding resistance in the axial direction of the piston 7.

Further, in the present embodiment, in order to make the meshing operation of the first meshing portion 8 work securely before the meshing operation of the second meshing portion 9, the structure is made such that the actuation resistance of the second meshing portion 9 is increased in comparison with the actuation resistance of the first meshing portion 8, however, if the lead of the first meshing portion 8 is made larger in comparison with the lead of the second meshing portion 9, the meshing operation of the first meshing portion 8 works before the meshing operation of the second meshing portion 9.

Further, the structure is made such that the filling member 4 quickly appears from and retract into the leading tube 3 by making the lead of the first meshing portion 8 larger in comparison with the lead of the second meshing portion 9 and, on the other hand, the applying filler L is properly slowly discharged by the piston movable body 6 (the piston 7) and the filling member 4 moves quicker than the piston movable body 6 (the piston 7), however, it is possible to make the lead of the first meshing portion 8 same as the lead of the second meshing portion 9 to make the moving speed of the filling member 4 same as the moving speed of the piston movable body 6 (the piston 7). In this case, as mentioned above, it is necessary to employ a structure in which the meshing operation of the first meshing portion 8 works before the meshing operation of the second meshing portion 9, such as the structure in which the actuation resistance of the second meshing portion 9 is increased in comparison with the actuation resistance of the first meshing portion 8. In this case, if the lead of the first meshing portion 8 is made smaller in comparison with the lead of the second meshing portion 9, it is possible to move the piston movable body 6 (the piston 7) quicker than the filling member 4.

In this connection, the outer surface 4*a* of the filling member 4 may be provided with a porous member, for example, an urethane foam, a fine net-type material or the like so as to serve as the applying portion, the outer surface 4*a* may be provided with a cilia or the like so as to serve as the applying portion, or a brush formed by bundling tapered polyester fibers may be attached so as to serve as the applying portion.

FIG. 29 is a vertical sectional view showing an applying filler extruding container in accordance with a second embodiment of the present invention, and is a view of the state at a time when the filling member moves forward to the maximum on the basis of an operation of a user and the piston subsequently moves forward so as to be set to a use state.

An applying filler extruding container 200 in accordance with the second embodiment is different from the applying filler extruding container 100 in accordance with the first embodiment in a point that a filling member 18 provided with an applying body 17 in a leading end portion is used in place of the filling member 4 in which the outer surface 4*a* is formed as the applying portion. The applying body 17 is constituted by an elastic body formed, for example, by a rubber material, an elastomer material or the like, and is provided with a curved disc shaped applying portion 17*a* curved in such a manner that a portion near a center portion protrudes, and an annular installation portion 17*b* continuously provided in a back surface in a peripheral edge side of the applying portion 17*a* so as to protrude to a rear side.

The applying portion 17*a* is provided with a discharge port 17*c* for communicating an inner surface with an outer surface and discharging the applying filler L, and the installation portion 17*b* is provided with an annular groove portion 17*d* depressed to an axis side in an outer peripheral surface at a root position in a side of the applying portion 17*a*, as a structure which is engaged with a peripheral edge portion 18*d* forming an opening 18*c* in a leading end portion of the filling member 18. Further, a plurality of protruding portions 17*e* are provided in an outer surface of the applying portion 17*a*.

The applying body 17 is inserted inside the opening 18*c* of the filling member 18 while the installation portion 17*b* being deflected to the axis side, a rear end portion of the installed portion 17*b* enters into the filling member 18, and the annular groove portion 17*d* is engaged with the peripheral edge portion 18*d* forming the opening 18*c* of the filling member 18, whereby the applying body 17 is installed to the filling member 18 so as not to break away therefrom and is positioned at the opening 18*c*. The other structure is the same as the first embodiment.

The structure having the applying body 17 in the leading end portion of the filing member 18 is included in the structure in which the filling member 18 is provided with the applying portion 17*a* having the discharge port 17*c* in the leading end portion and provided for applying the applying filler L discharged through the discharge port 17*c* to the applied portion, in the same manner as the first embodiment. Accordingly, it is possible to achieve the same operation and effect as those of the first embodiment.

In this case, the protruding portion 17*e* may be omitted, the number of the discharge port 17*c* may be set to plural number, and the applying body 17 may be constituted by an elastic body made of a porous material, for example, an urethane foam, a fine net-type material or the like, in which the porous portion serves as the discharge port.

FIG. 30 is a transverse sectional view showing an applying filler extruding container in accordance with a third embodiment of the present invention, and is a view as seen from an arrow XXX—XXX in FIG. 1.

An applying filler extruding container 300 in accordance with the third embodiment is different from the applying filler extruding container 100 in accordance with the first embodiment in a point that the container is provided with a click engagement portion 19 which gives a click feeling in synchronization with the relative rotation between the main body tube 1 and the leading tube 3 at a time of feeding the piston 7. The click engagement portion 19 is constituted by a click engagement protruding portion 20*d* and a click engagement groove 21*a* provided in a filling member movable body 20 and a piston movable body 21 respectively used in place of the filling member movable body 5 and the piston movable body 6, and an O-ring 11.

The piston movable body 21 is provided with a plurality of click engagement grooves 21*a* extending in an axial direction at uniformly arranged positions in a circumferential direction on an outer peripheral surface thereof, and is provided with a male thread 21*b* constituting one side of the second meshing portion 9 in such a manner as to cross the click engagement groove 21*a*, be formed in a circular arc shape and be continuously provided in an axial direction. The click engagement groove 21*a* is provided over a forming range in an axial direction of the male thread 21*b*.

The filling member movable body 20 is provided with a slit from a leading end in an outer diameter small-diameter portion 20*a* in a leading end, is divided into four sections along a peripheral direction, is provided with female threads 20*j* and 20*j* constituting the other side of the second meshing portion 9 and meshing with the male thread 21*b*, in a front half portion of a circular arc shaped inner peripheral surface of the facing one side divided pieces (the divided pieces in a lateral direction of the drawing) 20*b* and 20*b*, and is provided with the click engagement protruding portions 20*d* and 20*d* click engaging with the click engagement groove 21*a*, in a circular arc shaped inner peripheral surface of the facing the other side divided pieces (the divided pieces in a vertical direction of the drawing) 20*c* and 20*c*.

These four divided pieces 20*b* and 20*c* are fastened by the O-ring 11 fitted to a circular arc shaped groove portion 20*m* provided in outer peripheral surfaces thereof. Accordingly, in the same manner as the first embodiment, the actuation resistance of the second meshing portion 9 is increased. Further, the click engagement protruding portion 20*d* is energized to the click engagement groove 21*a* by utilizing an elastic force of the O-ring 11, whereby a proper click engagement between the click engagement protruding portion 20*d* and the click engagement groove 21*a* is achieved. The other structures are the same as the first embodiment.

In accordance with the applying filler extruding container 300 having the click engagement portion 19 mentioned above, when the filling member 4 reaches the forward limit on the basis of the relative rotation in the feeding direction between the main body tube 1 and the leading tube 3 by a user, and the main body tube 1 and the leading tube 3 are further relatively rotated in the feeding direction, the piston movable body 21 (the piston 7) moves forward by the male thread 21*b* of the piston movable body 21 and the female thread 20*j* of the filling member movable body 20 which constitute the second meshing portion 9, and the click engagement protruding portion 20*d* and the click engagement groove 21*a* which constitute the click engagement portion 19 repeat the click engagement in accordance with the forward movement of the piston movable body 21 (the piston 7). Accordingly, the proper click feeling is given to the user, a degree of the relative rotation in the feeding direction and a forward moving degree of the piston movable body 21 (the piston 7) are detected by the user, and the applying filler L can be discharged at a proper amount. In this case, the structure in accordance with the third embodiment can be, of course, applied to the structure in which the applying portion is formed as the applying body as in the second embodiment.

FIG. 31 is a transverse sectional view showing an applying filler extruding container in accordance with a fourth embodiment of the present invention, and is a corresponding view as seen from an arrow to FIG. 30.

An applying filler extruding container 400 in accordance with the fourth embodiment is different from the applying filler extruding container 300 in accordance with the third embodiment in a point that the click engagement protruding portion 20*d* of the filling member movable body 20 is replaced by a ratchet gear 20*x*, the click engagement groove 21*a* of the piston movable body 21 is replaced by a ratchet groove 21*x* meshing with the ratchet gear 20*x*, the ratchet gear 20*x* and the ratchet groove 21*x* are formed in a shape allowing the relative rotation in the feeding direction of the main body tube 1 and the leading tube 3, and a ratchet mechanism 19*x* is structured by the ratchet gear 20*x*, the ratchet groove 21*x* and the O-ring 11. The ratchet mechanism 19*x* regulates the relative rotation in the feed-back direction between the main body 1 and the leading tube 3 at a time when the meshing operation by the second meshing portion 9 works, and allows the relative rotation in the feeding direction. The other structures are the same as those of the third embodiment.

In the ratchet mechanism 19*x*, in the same manner as the third embodiment, the actuation resistance of the second meshing portion 9 is increased by the O-ring 11, and a proper meshing between the ratchet gear 20*x* and the ratchet groove 21*x* is achieved.

In accordance with the applying filler extruding container 400 having the ratchet mechanism 19*x* mentioned above, since the ratchet gear 20*x* and the ratchet groove 21*x* constituting the ratchet mechanism 19*x* repeat the meshing (the engagement and disengagement) therebetween at a time when the meshing operation of the second meshing portion 9 works on the basis of the relative rotation in the feeding direction of the main body tube 1 and the leading tube 3 and the piston movable body 21 (the piston 7) moves forward, a proper resistance feeling (a click feeling) is given to a user, the degree of the relative rotation in the feeding direction and the forward moving degree of the piston movable body 21 (the piston 7) are detected by the user approximately in the same manner as the third embodiment, and the applying filler L can be discharged at a proper amount.

FIG. 32 is a vertical sectional view showing an applying filler extruding container in accordance with a fifth embodiment of the present invention, and a view of the state at a time when the filling member backward moves to the maximum on the basis of the operation after being used by a user and the piston subsequently moves backward to the maximum, FIG. 33 is a partly broken perspective view showing the applying filler extruding container in accordance with the fifth embodiment of the present invention and a view of the state just before the filling member backward moves to the maximum on the basis of the operation after being used by the user and the piston subsequently moves backward to the maximum, and FIG. 34 is an enlarged view of a main portion of FIG. 33.

An applying filler extruding container 500 in accordance with the fifth embodiment is different from the applying filler extruding container 100 in accordance with the first embodiment in a point that the structure is made such that the meshing projection 5*e* of the filling member movable body 22 is accommodated within the spiral groove 23*b* of the leading tube 23 at a time when the applying filler extruding container 500 is in an initial state shown in FIG. 32, the rear end surface of the filling member movable body 22 is brought into contact with the bottom portion of the main body tube 1 and the filling member 4 reaches the backward limit, by using the filling member movable body 22 obtained by replacing the spring portion 5*d* of the filling member movable body 5 by the cylinder portion 22*d* having no spring characteristic, and using the leading tube 23 obtained by replacing the spiral groove 3*b* of the leading tube 3 by the spiral groove 23*b* extending to the tube rear end.

Further, in the applying filler extruding container 500 in accordance with the fifth embodiment, the structure is made such that the rear end surface of the piston movable body 6 reaches the bottom portion of the main body tube 1 at a time when the applying filler extruding container 500 is in the initial state shown in FIG. 32, and a shaft body wrench-off preventing mechanism preventing the shaft body 1*b* from being wrenched off is provided in the rear end portion of the piston movable body 6 and the bottom portion of the main body tube 1.

The main body tube 1 having the shaft body wrench-off preventing mechanism is provided with a protruding portion 1*g* protruding short to the leading end side and provided for engaging with the piston movable body 6 in a rotational direction at a time of the maximum backward movement of the piston movable body 6, in a peripheral edge of the shaft body 1*b* in the bottom surface thereof, as shown in FIGS. 6 to 9 and FIGS. 32 to 34. The protruding portion 1*g* structures one side of the shaft body wrench-off preventing mechanism, and is provided so as to be connected to the rear end portion of each of the protrusions 1*c* of the shaft body 1*b*, as shown in FIGS. 6 to 9.

Further, the piston movable body 6 having the shaft body wrench-off preventing mechanism is provided with grooves 6*f* depressed short to the leading end side and connecting inner and outer sides of the piston movable body 6 at six uniformly arranged positions along the peripheral direction of the rear end surface, as shown in FIGS. 15 to 18 and FIGS. 32 to 34. The grooves 6*f* structure the other side of the shaft body wrench-off preventing mechanism, and move forward to the protruding portion 1*g* of the main body tube 1 so as to be engaged in the rotational direction, at a time of the maximum backward movement of the piston movable body 6.

Further, in the applying filler extruding container 500, there is employed a leading tube pressing member 92 obtained by replacing the spring portion 2*d* of the leading tube pressing member 2 by a cylinder portion 92*d* having no spring characteristic. The spring portion 2*d* of the leading tube pressing member 2 is replaced by the cylinder portion 92*d* having no spring characteristic as mentioned above because of the following reason. Since the spring portion 5*d* of the filling member movable body 5 is replaced by the cylinder portion 22*d* having no spring characteristic, if the main body tube 1 and the leading tube 23 are further relatively rotated in the feed-back direction in a state that the rear end surface of the cylinder portion 22*d* of the filling member movable body 22 is brought into contact with the bottom portion of the main body tube 1 and the filling member 4 reaches the backward limit, the leading tube 23 moves to the front side against the energizing force of the spring portion 2*d* of the leading tube pressing member 2, whereby the meshing projection 5*e* of the filling member movable body 22 comes off from the rear end of the spiral groove 23*b* of the leading tube 23, the meshing is cancelled, and it is impossible to work the meshing operation of the second meshing portion 9 in the feeding direction. Further, in accordance with the modification, an O-ring 99 is arranged between a front side surface of the collar portion 23*a* in a rear end of the leading tube 23 and a rear side surface of the leading tube pressing member 92. A better rotational resistance is generated between the leading tube 23 and the main body tube 1 on the basis of the O-ring 99. The other structures are the same as the first embodiment.

In accordance with the applying filler extruding container 500 having the structure mentioned above, when the main body tube 1 and the leading tube 23 are relatively rotated in the feeding direction by a user in the initial state shown in FIG. 32, the first meshing portion 8 is structured and the meshing operation works first since the meshing projection 5*e* of the filling member movable body 22 is already meshed with the spiral groove 23*b* of the leading tube 23. Thereafter, the same operation as the first embodiment is executed, the filling member 4 reaches the forward limit on the basis of the further relative rotation in the feeding direction, the piston movable body 6 (the piston 7) moves forward, the applying filler L is discharged from the discharge port 4*c* so as to be set to the use state, the filling member 4 including the piston movable body 6 (the piston 7) moves backward on the basis of the relative rotation in the feed-back direction of the main body tube 1 and the leading tube 23 after being used, and the filling member 4 and the applying portion 4*a* are retracted into the leading tube 23.

Further, when the rear end surface of the filling member movable body 22 is brought into contact with the bottom portion of the main body tube 1 and the filling member 4 reaches the backward limit, the further backward movement of the meshing projection 5*e* of the filling member movable body 22 is inhibited, and the meshing operation of the first meshing portion 8 is stopped.

When the main body tube 1 and the leading tube 23 are subsequently rotated relatively in the feed-back direction, the meshing operation of the second meshing portion 9 works because of the stop of the meshing operation of the first meshing portion 8, and the piton movable body 6 and the piston 7 move backward on the basis of a cooperation with the rotation preventing portion 50.

At this time, the applying filler L is sucked into the filling region 4*x* from the discharge port 4*c* of the filling member 4 on the basis of the backward movement of the piston 7, and a predetermined space A is formed in an inner side than the discharge port 4*c* of the filling member 4, as shown in FIG. 32. Accordingly, the applying filler L left in the applying portion 4*a* is reduced so as to obtain an economical effect, and it is possible to prevent the applying filler L from leaking out from the discharge port 4*c* of the applying filler L on the basis of the predetermined space A provided in the inner side from the discharge port 4*c*, even if the applying filler L filled in the filling region 4*x* and air mixed in the applying filler L are expanded due to a temperature change or a change in an atmospheric pressure.

In this case, since the piston 7 can move backward in the present embodiment, if a relative rotating force for moving further backward is applied to the piston movable body 6 staying at the maximum backward position shown in FIG. 32 by a user, it seems that the shaft body 1*b* engaging with the piston movable body 6 is wrenched off in the bottom surface of the main body tube 1.

However, in the present embodiment, since a plurality of protruding portions 1*g* in the bottom surface of the main body tube 1 and a plurality of grooves 6*f* in the rear end surface of the piston movable body 6 are engaged in the rotational direction at a time of the maximum backward movement of the piston movable body 6, the rotating force applied to the shaft body 1*b* for moving the piston movable body 6 further backward is applied to the protruding portion 1*g* of the main body tube 1 via the groove 6*f* of the piston movable body 6 so as to be dispersed, whereby the shaft body 1*bc* is prevented from being wrenched off. Further, if the main body tube 1 and the leading tube 23 are relatively rotated in the feeding direction by a user, the same operation as mentioned above is executed, and the operation mentioned above is repeated.

In this case, the structure may be made such that a concave portion is provided in place of the groove 6*f* of the piston movable body 6 for preventing the shaft body 1*b* from being wrenched off, and the concave portion is engaged with the protruding portion 1*g* of the main body tube 1 in the rotational direction. Further, as another embodiment of the shaft body wrench-off preventing mechanism, the structure may be made such that convex portions protruding to a rear side are provided at a plurality of positions along a peripheral direction, in the rear end surface of the piston movable body 6 in a reverse manner to the foregoing shaft body wrench-off preventing mechanism, and a plurality of concave portions, in which the convex portions of the piston movable body 6 enter so as to be engaged in the rotational direction at a time of the maximum backward movement of the piston movable body 6, are provided in the peripheral edge of the shaft body 1*b* in the bottom surface of the main body tube 1. In this case, the structure in accordance with the fifth embodiment can be, of course, applied to the structure in which the applying portion is formed as the applying body as in the second embodiment.

Further, it is possible to employ the click engagement portion 19 described in the third embodiment for the applying filler extruding container 500. If the click engagement portion 19 is employed, the click engagement groove 21*a* and the click engagement protruding portion 20*d* constituting the click engagement portion 19 repeat the click engagement at a time when the meshing operation of the second meshing portion 9 works on the basis of the relative rotation in the feeding direction and the feed-back direction of the main body tube 1 and the leading tube 23 and the piston 7 moves forward and backward, and the click feeling is given to a user. Accordingly, the degree of the relative rotation in the feeding direction and the feed-back direction and the moving degree of the piston movable body 6 (the piston 7) are detected by the user, the applying filler L can be discharged at a proper amount in the case of being relatively rotated in the feeding direction, and the piston movable body 6 (the piston 7) is prevented from being excessively returned in the case of being relatively rotated in the feed-back direction.

The description is particularly given above of the present invention on the basis of the embodiment mentioned above, however, the present invention is not limited to the embodiment mentioned above. For example, the male thread and the female thread may be replaced by those which have the same function of a thread, such as an intermittently arranged projection group or spirally, and an intermittently arranged projection group, and the meshing projection may be replaced by a continuous thread.

Further, in the embodiment mentioned above, the structure is made such that the filling members 4 and 18 are completely retracted in the leading tubes 3 and 23 so as to be accommodated, however, the present invention includes the filing extruding container structured such that the leading ends of the filling members 4 and 18 protrude slightly from the leading tubes 3 and 23 even if the filling members 4 and 18 are moved backward to the backward limit. It is possible to obtain the same effect as in the case that the filling member is completely retracted even if the structure is made as mentioned above.

What is claimed is:

1. An applying filler extruding container comprising:

a main body;

a leading tube installed in a leading end side of the main body so as to be relatively rotatable; and a filling member which moves forward into the leading tube, has an inner portion formed as a filling region in which the applying filler is filled, has a discharge port in a leading end portion and is provided with an applying portion for applying said applying filler discharged through said discharge port to an applied portion, wherein, when said main body and said leading tube are relatively rotated in one direction, meshing operation of a first meshing portion works and thereby said filling member moves forward, and when they are relatively rotated further in said one direction, meshing operation of a second meshing portion instead of said first meshing portion works and thereby said applying filler is discharged from said discharge port of said filling member, and wherein, when said main body and said leading tube are relatively rotated in the other direction corresponding to an opposite direction to said one direction, meshing operation of said first meshing portion works and thereby said filling member moves backward.

2. The applying filler extruding container as claimed in claim 1, wherein the applying filler extruding container is provided with a movable body moving forward and thereby extruding said applying filler in said filling region toward said discharge port, wherein the first meshing portion works first a meshing operation when said main body and said leading tube are relatively rotated in a feeding direction corresponding to said one direction and a feed-back direction corresponding to said other direction and thereby moves forward and backward said filling member including said movable body, and the meshing operation is stopped when said filling member reaches a forward limit, and wherein the second meshing portion works the meshing operation when said main body and said leading tube are relatively rotated further in the feeding direction corresponding to said one diction in a state that said filling member reaches the forward limit and the meshing operation of said first meshing portion stops and thereby moves forward said movable body.

3. The applying filler extruding container as claimed in claim 2, wherein the meshing operation of said first meshing portion works before the meshing operation of said second meshing portion by increasing an actuation resistance of said second meshing portion in comparison with an actuation resistance of said first meshing portion.

4. The applying filler extruding container as claimed in claim 3, wherein the applying filler extruding container is provided with an elastic portion applying an elastic force to said second meshing portion, and wherein the actuation resistance of said second meshing portion is increased by utilizing the elastic force of the elastic portion.

5. The applying filler extruding container as claimed in claim 4, wherein said elastic portion is constituted by a ring-shaped elastic body installed to an outer peripheral side of a female thread constituting said second meshing portion.

6. The applying filler extruding container as claimed in claim 2, wherein the applying filler extruding container is provided with a click engagement portion which is click engaged in correspondence to the relative rotation between said main body and said leading tube at a time when the meshing operation by said second meshing portion works.

7. The applying filler extruding container as claimed in claim 6, wherein said click engagement portion constituted by a ratchet mechanism which regulates the relative rotation in the feed-back direction between said main body and said leading tube at a time when the meshing operation by said second meshing portion works, and allows only the relative rotation in the feeding direction.

8. The applying filler extruding container as claimed in claim 2, wherein said first meshing portion is structured such that when said main body and said leading tube are relatively rotated in the feed-back direction and said filling member including said movable body moves backward on the basis of the first worked meshing operation of said first meshing portion so as to reach a predetermined position at which said applying portion is accommodated within said leading tube, the meshing is cancelled and the first meshing portion idly rotates said main body and said leading tube so that the meshing operation of said second meshing portion does not work, and wherein the meshing of said first meshing portion returns when said main body and said leading tube are relatively rotated in said feeding direction in a state that the meshing is cancelled.

9. The applying filler extruding container as claimed in claim 2, wherein the applying filler extruding container is provided with a leading tube pressing member which is accommodated within said main body and comprises a spring portion capable of expanding and contracting in an axial direction, and wherein said leading tube is installed to said main body via said leading tube pressing member so as to be relatively rotatable in a state of being energized to a rear side by the spring portion of said leading tube pressing member.

10. The applying filler extruding container as claimed in claim 9, wherein said first meshing portion is structured such that the meshing operation is stopped when said main body and said leading tube are relatively rotated in the feed-back direction, said filling member including said movable body moves backward on the basis of the first worked meshing operation of said first meshing portion and said applying portion reaches the backward limit to be accommodated within said leading tube, and wherein said second meshing portion is structured such that the meshing operation works so as to move backward said movable body when said filling member reaches the backward limit and said main body and said leading tube are relatively rotated further in the feed-back direction in a state that the meshing operation of said first meshing portion is stopped.

11. The applying filler extruding container as claimed in claim 10, wherein a lead of said first meshing portion is made larger in comparison with a lead of said second meshing portion.

12. The applying filler extruding container as claimed in claim 2, wherein said first meshing portion is structured such that the meshing operation is stopped when said main body and said leading tube are relatively rotated in the feed-back direction, said filling member including said movable body moves backward on the basis of the first worked meshing operation of said first meshing portion and said applying portion reaches the backward limit to be accommodated within said leading tube, and wherein said second meshing portion is structured such that the meshing operation works so as to move backward said movable body when said filling member reaches the backward limit and said main body and said leading tube are relatively rotated further in the feed-back direction in a state that the meshing operation of said first meshing portion is stopped.

13. The applying filler extruding container as claimed in claim 12, wherein a lead of said first meshing portion is made larger in comparison with a lead of said second meshing portion.

14. The applying filler extruding container as claimed in claim 2, wherein a lead of said first meshing portion is made larger in comparison with a lead of said second meshing portion.

* * * * *